United States Patent [19]

Kimura et al.

[11] 4,179,211

[45] Dec. 18, 1979

[54] ELECTROSTATIC PHOTOGRAPHIC COPYING MACHINE

[75] Inventors: Hiroshi Kimura, Neyagawa; Takaich Kitagawa, Takatsuki; Masahiko Hisajima, Suita; Shoji Yoshikado, Sakai; Tatsuo Aizawa, Osaka, all of Japan

[73] Assignees: Mita Industrial Co., Ltd., Osaka, Japan; Mita Industrial Co., Ltd., Osaka, Japan

[21] Appl. No.: 802,973

[22] Filed: Jun. 2, 1977

[30] Foreign Application Priority Data

| | | | |
|---|---|---|---|
| Jun. 2, 1976 | [JP] | Japan | 51-72007[U] |
| Jun. 17, 1976 | [JP] | Japan | 51-79470[U] |
| Jun. 17, 1976 | [JP] | Japan | 51-79471[U] |
| Jun. 17, 1976 | [JP] | Japan | 51-96015[U] |
| Jun. 17, 1976 | [JP] | Japan | 51-96016[U] |
| Jun. 17, 1976 | [JP] | Japan | 51-96017[U] |
| Jun. 28, 1976 | [JP] | Japan | 51-76188 |
| Oct. 4, 1976 | [JP] | Japan | 51-119600 |

[51] Int. Cl.[2] ..... G03G 15/00

[52] U.S. Cl. ..... 355/14 R; 355/3 DR; 355/3 DD; 355/3 SH; 355/15; 355/16

[58] Field of Search ..... 355/3 DR, 16, 3 R, 35 H, 355/3 TR, 15, 14, 3 DD

[56] References Cited

U.S. PATENT DOCUMENTS

| | | | |
|---|---|---|---|
| 3,186,838 | 6/1965 | Graff et al. | 355/15 X |
| 3,480,361 | 11/1969 | Doi et al. | 355/16 |
| 3,600,086 | 8/1971 | Cates | 355/16 |
| 3,615,128 | 10/1971 | Bhagat | 355/3 R |
| 3,796,183 | 3/1974 | Thettu | 355/3 FU |
| 3,829,208 | 8/1974 | Van Meijel | 355/3 DR |
| 4,068,942 | 1/1978 | Penwell | 355/3 DR |
| 4,086,006 | 4/1978 | Hauser et al. | 355/3 DD |

*Primary Examiner*—R. L. Moses

*Attorney, Agent, or Firm*—Wenderoth, Lind & Ponack; Wenderoth, Lind & Ponack

[57] ABSTRACT

An electrostatic photographic copying machine includes a device for automatically exchanging used master paper with fresh master paper on a master holding body, and for indicating when such an exchange should be initiated. The machine includes an apparatus for cleaning the fixing roller, an apparatus for adjusting the amount of toner supplied to the developer, a transfer device whereby improper discharge is prevented, a transfer paper jam detector, and a device for improved mixing of developer.

102 Claims, 26 Drawing Figures

ELECTROSTATIC PHOTOGRAPHIC COPYING MACHINE

BACKGROUND OF THE INVENTION

This invention relates to an electrostatic photographic copying machine of the type including a master holding body having attached to the peripheral surface thereof an electrostatic photographic sensitive master paper, a charging apparatus, a development apparatus and a transfer apparatus arranged along the moving surface of the master holding body, an optical system to project an image of a copying original paper onto the surface of the master paper charged by the charging apparatus, a transfer paper carrying passage to supply transfer paper to the transfer apparatus and to discharge transfer paper when the image from the master paper is transferred to the transfer paper, and a fixing apparatus to fix the transferred image onto the transfer paper.

SUMMARY OF THE INVENTION

It is the primary object of the present invention to provide such an apparatus wherein exchanging of the master paper can be performed automatically and surely.

It is another object of the present invention to provide such an apparatus whereby the necessary time for exchanging the master paper can be made known easily and surely.

It is another object of the present invention to provide such an apparatus in which the fixing roller in the fixing apparatus can always be cleaned effectively so that a clear copy will always be obtained.

It is another object of the present invention to provide such an apparatus wherein the transfer paper can be simply and surely separated from the master holding body.

It is another object of the present invention to provide such an apparatus including a toner supply apparatus having a simple construction and making the quantity of toner supplied adjustable at will corresponding to the original paper in the development apparatus.

It is another object of the present invention to provide such an apparatus that will prevent toner falling from the master paper from adhering to the shield casing of the charging apparatus, and whereby removal of such fallen toner is facilitated.

It is another object of the present invention to provide an apparatus in which jamming of the transfer paper can be precisely detected.

It is another object of the present invention to provide an apparatus in which the developer can be effectively stirred and mixed.

BRIEF DESCRIPTION OF THE DRAWINGS

Other and further objects, features and advantages of the invention will appear more fully from the following description taken with the accompanying drawings, wherein.

DETAILED DESCRIPTION OF THE INVENTION

The various components of the copying machine of the present invention will now be described.

Exchanging Apparatus for Master Paper

Figure 1:
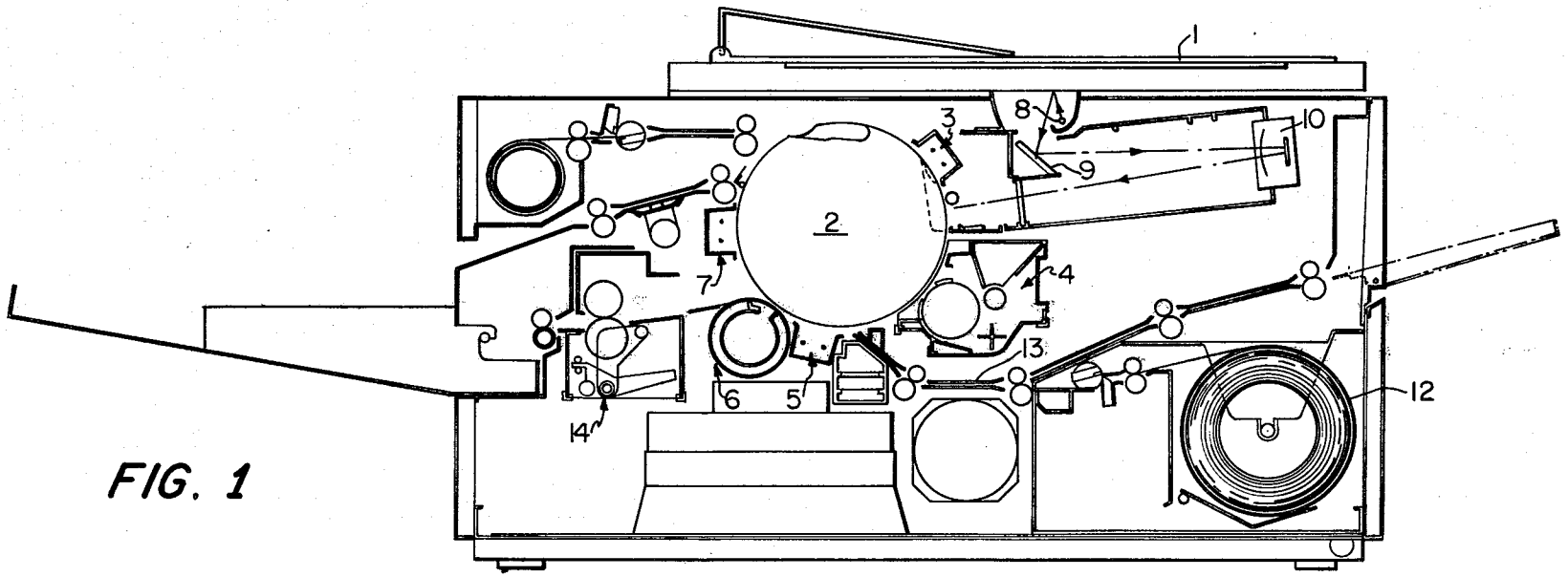
FIG. 1 is a sectional side view showing the general configuration of the copying machine of the invention.

FIG. 1 shows the general construction of the electrostatic photographic copying machine, and in FIG. 1, 1 is an original paper mounting table, and 2 is a master holding body, e.g. a rotary drum on which an electrostatic photographic sensitive master paper is attached. Body 2 is constructed to be rotated in forward and reverse directions and has arranged around the periphery thereof a charging apparatus 3, a development apparatus 4, a transfer apparatus 5, a separating apparatus 6 and a cleaning apparatus 7. 8 is a light source, and conventional optical devices such as mirror 9 and lens 10 are provided between the path from light source 8 to one part of the peripheral surface of master holding body 2. 12 is a supply of transfer paper wound in roll form, 13 a transfer paper carrying passage to carry and guide transfer paper 12 up to transfer apparatus 5, whereat the image on the surface of the master paper is transferred to the transfer paper, and 14 a fixation apparatus to perform a fixation treatment of the transfer paper transferred by transfer apparatus 5 and separated from the master paper by separating apparatus 6.

A master paper exchanging apparatus according to one practical example of the present invention is provided at a position above fixation apparatus 14.

Figure 2:
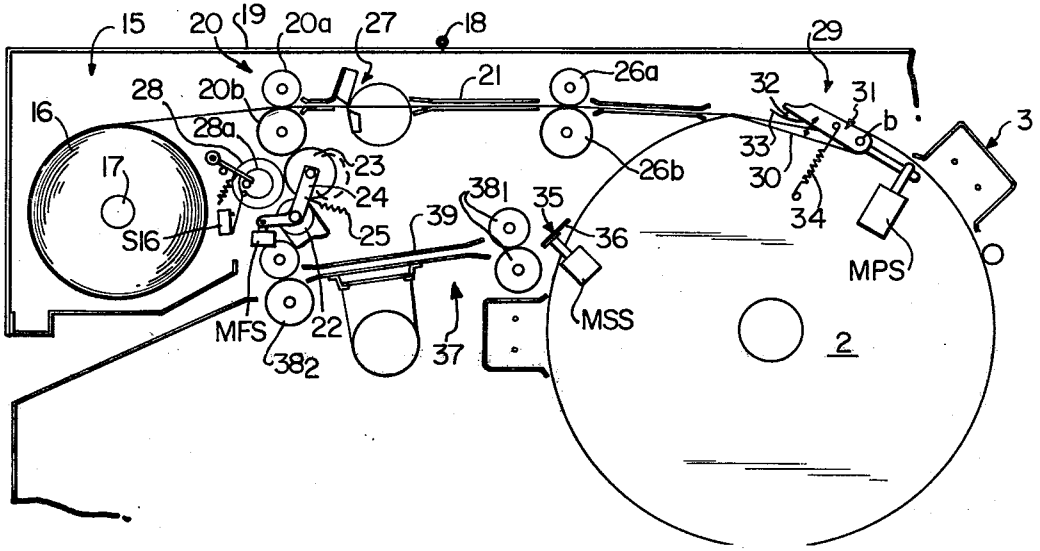
FIG. 2 is a sectional side view of a portion of the machine of FIG. 1.

FIG. 2 shows this feature in more detail, and in FIG. 2 master paper exchanging apparatus 15 includes master paper 16 wound in a roll about shaft 17 which is rotatively supported by bearings (not shown).

19 is a cover member constructed so as to be freely pivoted about hinge 18 between opened and closed positions. Cover member 19 is opened for maintenance or inspection of the interior, or for exchanging of master paper 16.

A carrying apparatus 20 to carry master paper 16 up to master holding body 2 along guide passage 21 includes a pair of rollers 20*a* and 20*b* vertically positioned to pinch therebetween master paper 16. A driving roller 22 is driven by a driving source (not shown). 23 is a rotatively mounted idler roller. An oscillating lever 24 of a substantially L-shaped configuration is pivoted on the center line of rotation of driving roller 22 and has mounted at one end thereof roller 23, so the peripheral surface of roller 23 contacts the peripheral surface of driving roller 22. The other end of lever 24 is attached to solenoid MFS for feeding the master paper. A tension spring 25 is attached to one end of oscillating lever 24. Lower drive roller 20*b* is made to perform rotative driving or release of driving operations by members 22–25. Namely, roller 23 is normally urged to the position shown by the phantom line due to the elastic force of tension spring 25, and does not contact lower drive roller 20*b*. Accordingly, lower drive roller 20*b* is not driven, and feeding of master paper 16 is stopped. But when solenoid MFS is energized, lever 24 is oscillated to the position of the solid line, and roller 23 is pressed into contact with roller 20*b*. As a result, roller 20*b* is rotatively driven by driving roller 22 through idler roller 23, and feeding of master paper is achieved.

Feeding means rollers 26*a* and 26*b* are similar to rollers 20*a* and 20*b*. However, when the function of feeding master paper 16 can be carried out by rollers 20*a* and 20*b* only, then rollers 26*a* and 26*b* may be omitted.

A cutting mechanism 27 cuts master paper 16 to a proper length, and timing of the cutting operation is controlled by limit switch S16.

Limit switch S16 slidably contacts cam surface 28*a* formed on a roller 28 which is rotated by contact with idler roller 23 when solenoid MFS is energized. Switch S16 is closed at each rotation of roller 28, and causes cutting mechanism 27 to perform a cutting motion. The diameter of roller 28 corresponds to the length of master paper 16 to be cut.

Figure 3B:
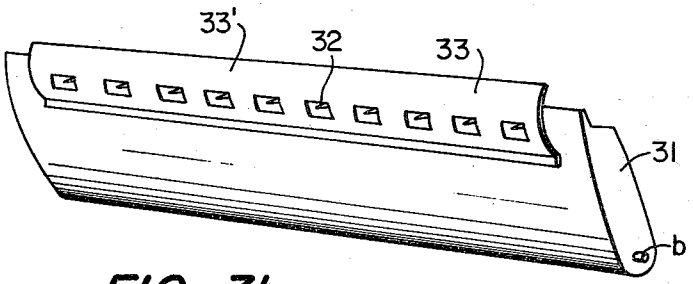
FIGS. 3*a* and 3*b* are perspective views of alternative embodiments of a main feature of the invention.
Figure 3A:
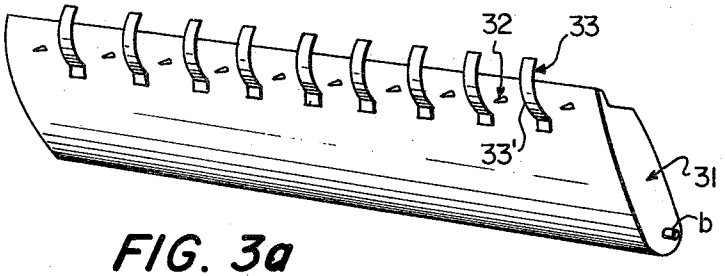

An engaging device 29 causes the front end of the fed master paper 16 to engage with master holding body 2. A restraining member 31 is provided in a depression 30 formed in master holding body 2 and is turnable around fulcrum b. Member 31 is provided on an inner surface thereof with a stopper 32 (e.g. a plurality of needle-shaped projections), and with a guide member 33 (e.g. plate springs). The projections and plate springs do not overlap, and member 33 may be separate plate springs (FIG. 3*a*) or a single plate spring (FIG. 3*b*). Restraining member 31 is normally urged into depression 30 by the elastic force of tension spring 34, and it is moved to the position shown in FIG. 2 when engaging solenoid MPS is energized, so that the front end of master paper 16 may be received therein. Guide edge 33' of guide member 33 functions to guide the front end of master paper 16 to a prescribed position during the attaching operation of the master paper. When solenoid MPS is then deenergized, spring 34 urges member 31 into depression 30, and member 33 is flexed and member 32 pierces master paper 16, thereby grasping the master paper. Thereafter, when solenoid MPS is activated and member 31 is pivoted to release the master paper, the elastic returning force of member 33 forcibly separates the pierced master paper from stopper 32.

A scraper 35 scrapes the rear end of the master paper attached to master holding body 2 and includes scraping nail 36 and scraping solenoid MSS operable to move nail 36 to the peripheral surface of master holding body 2. A discharging assembly 37 discharges the master paper scraped by scraper 35 to the outside of the machine and includes carrying rollers $38_1$ and $38_2$ and discharging guide passage 39.

Figure 4:
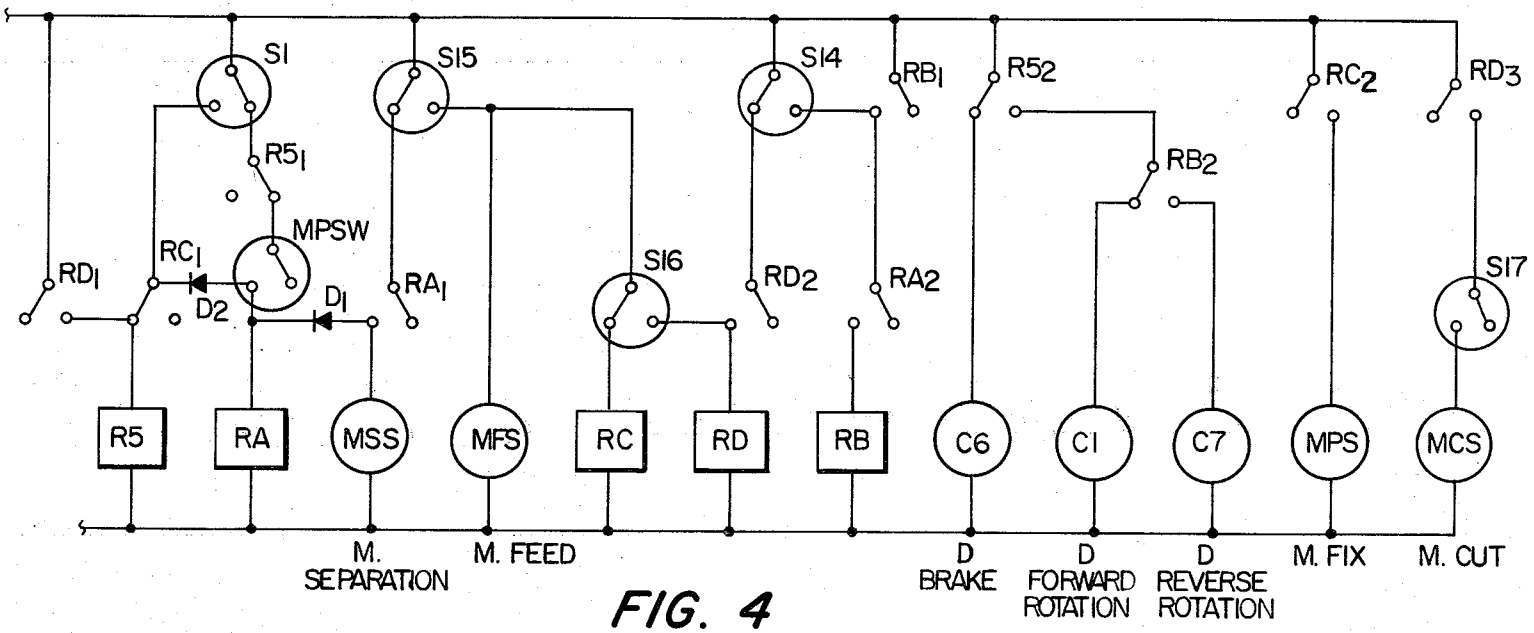
FIG. 4 is a circuit diagram of the features of FIG. 2.

FIG. 4 illustrates a circuit to automatically exchange the master paper in the arrangement shown in above FIG. 2. MSS, MFS and MPS are solenoids as described above, and MCS is a solenoid to operate cutting mechanism 27, MPSW a manually operated switch, S16 a detecting switch for determining the length of the master paper as discussed above, and S1, S14, S15 and S17 switches to be operated by rotation of master holding body 2. That is, S1 is a switch to be opened when master holding body 2 is stopping at the normal position for a copying operation, S14 is a switch to be closed when the rear end of the attached master paper passes through the position of scraper 35, S15 is a one-directional switch to be closed only when master holding body 2 is rotating in the reverse direction, and S17 is a switch to energize solenoid MCS for operating cutting mechanism 27 when master holding body 2 has reached a prescribed position. RA, RB, RC, RD and R5 are relays and their contacts, C1 is a clutch for stopping, and C7 is a clutch for rotation in the reverse direction. The switches and contacts are shown in the drawing in their respective opened (i.e. "OFF") positions.

When it is assumed that the master paper attached to the master holding body has reached the limit of copying durability as a result of copying operations being performed more than a prescribed number of times, the master paper is automatically exchanged by operation of manual switch MPSW by the operator. This operation will be described as follows.

(1) First, when MPSW is closed, relay RA is energized through S1→$R5_1$→MPSW, and its contact $RA_1$ is closed and made self-retaining through S15→$RA_1$→diode $D_1$. Solenoid MSS is simultaneously energized, and relay R5 is energized through diode $D_2$. When solenoid MSS is energized, scraping nail 36 of scraper 35 contacts with the surface of master holding body 2. On the other hand, when relay R5 is energized, clutch C1 for forward rotation is energized through its contact $R5_2$ and contact $RB_2$, and master holding body 2 starts a forward rotation.

(2) As described above, when master holding body 2 is rotated in the forward direction, and the rear end of the master paper attached to master holding body 2 passes through scraper 15, switch S14 is closed at this time, and relay RB is energized through S14→contact $RA_2$. Then clutch C7 for reverse rotation is energized through contact $R5_2$→$RB_2$, and master holding body 2 starts reverse rotation. Since scraping nail 36 is in contact with the surface of master holding body 2, the attached master paper is scraped from its rear end by the reverse rotation of master holding body 2, and the rear end of the master paper is carried to discharging assembly 37.

(3) When master holding body 2 has rotated in the reverse direction by a certain amount as discussed above, one-directional switch S15 is closed, and solenoid MSS and relays RA and R5 are deenergized, and solenoid MFS and relay RC are energized through S15 and S15→S16, respectively. By deenergizing relay R5, clutch C6 for stopping rotation is energized through contact $R5_2$, and rotation of master holding body 2 is stopped. Stopping of rotation is made to occur at the position shown in FIG. 2 by properly positioning switch S15. On the other hand, since relay RC is energized at this time, solenoid MPS is energized through contact $RC_2$. When restraining member 31 of engaging means 29 is raised, at the same time the front end of the master paper which had been engaged by stopper 32 is released from engagement by operation of the elastic returning force of guide member 33. As a result, the master paper is discharged from the machine while being forcibly guided by discharging assembly 37.

Since solenoid MFS is also energized, feeding rollers 20*a* and 20*b* are driven, and a new master paper 16 is carried out of apparatus 15 and fed onto master holding body 2. In this case, since master holding body 2 is stopping at the position shown in FIG. 2 as mentioned above, the front end of the new master paper 16 during feeding thereof enters smoothly into the space between raised plate member 31 and depression 30.

(4) When feeding a new master paper is started as discussed above, the length of master paper is detected by limit switch S16, and when it attains to a prescribed length S16 is closed. Then relay RC is deenergized, its contact RC is opened, and energizing of solenoid MPS is stopped. The front end of master paper 16 is engaged with master holding body 2 by engaging device 29. Relay RD is energized through S15→S16 and is made self-retaining through its contact $RD_2$ and S14, and relay R5 is energized through contact $RD_1$. When relay R5 is energized, since clutch C1 for forward rotation is energized in a manner similar to that described above with regard to step (1), master holding body 2 starts forward rotation with the front end of the new master paper attached thereto.

(5) When master holding body 2 is rotated in the forward direction, since one-directional switch S15 is opened, energizing of solenoid MFS and relay RC is stopped, and feeding rollers 20*a* and 20*b* stop feeding.

Switch S17 is closed at nearly the same time by rotation of master holding body 2, and solenoid MCS is energized through contact $RD_3$→S17. As a result, master paper 16 is cut off by operation of cutting mechanism 27.

The cut new master paper 16 is attached to the surface of master holding body 2 by the forward rotation thereof.

(6) On the other hand, when master holding body 2 has been rotated in the forward direction up to a position where the rear end of the attached master paper passes through the position of scraper 35, switch S14 is closed and relay RD is deenergized. Contact $RD_1$ is opened, clutch C1 for forward rotation is energized through contacts $R5_2$→$RB_2$, since relay R5 is energized through S1→contact $RC_1$, and accordingly master holding body 2 rotates further in the forward direction. However, when master holding body 2 is moved to the normal copying position, switch S1 is opened, and relay R5 is deenergized as a result, energizing of clutch C1 for forward rotation is stopped, and clutch C6 for stopping of rotation is energized, whereby master holding body 2 is stopped at such normal copying position.

The exchanging of the master paper is thus performed, and master holding body 2 is positioned for normal copying.

Figure 5:
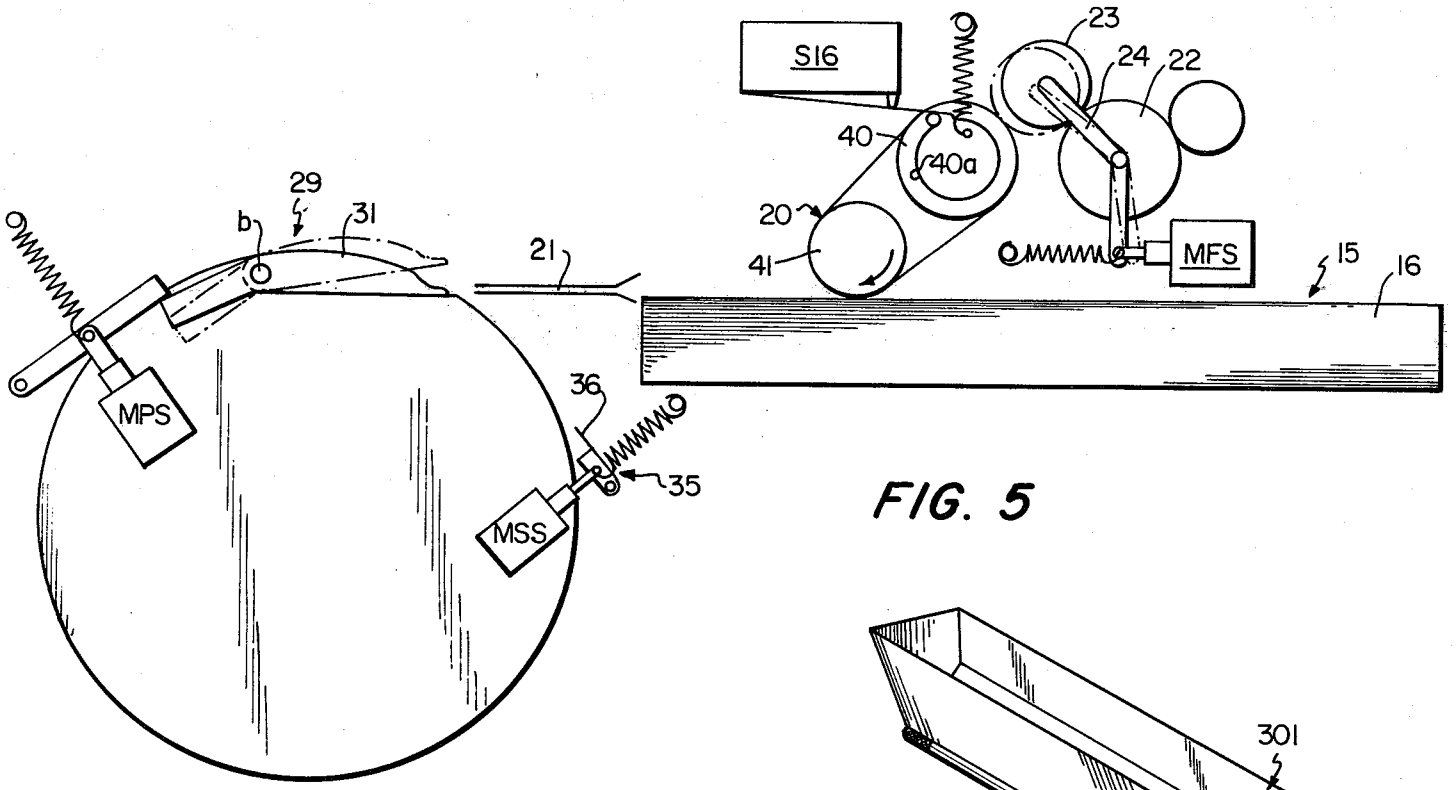
FIG. 5 is a schematic view of a modification of the feature of FIG. 2.

FIG. 5 shows another practical embodiment of the present invention. In this embodiment, since master paper 16 in sheet form is used, it differs from the embodiment of FIGS. 1–4 by the following points. Sheets of master paper 16 are piled in area 15. The cutting mechanism 27 is unnecessary. Since it is necessary to remove the master paper sheets 16 one by one from area 15, feeding apparatus 20 is formed so that a roll 41 having a comparatively large coefficient of friction is contacted with the top master paper sheet 16 as shown in the drawing.

Other features of this embodiment are similar to those of the embodiment of FIGS. 1–4. Further, although in this embodiment, a roller 40 is used to transmit power to feeding apparatus 20 and limit switch S16 slidably contacts cam surface 40*a* formed on roller 40 as a mechanism for detecting the length of master paper 16, the corresponding mechanisms used in the embodiment of FIGS. 1–4 can be used. Also, the mechanisms of this embodiment can be applied to the above embodiment of FIGS. 1–4.

Since the present invention includes the above features, the exchange of master paper relative to the master holding body can be performed automatically and surely, and accordingly the troublesome operation of exchanging master paper by hand becomes unnecessary, and also the contamination of the master paper can be prevented.

The front end of the master paper is guided to a prescribed position by the guide member when attaching the master paper, and separating of the front end of the master paper from the stopper by the guide member facilitates easy and sure removal of the master paper from the master holding body.

Apparatus for Indicating the Time to Exchange Master Paper

Figure 6:
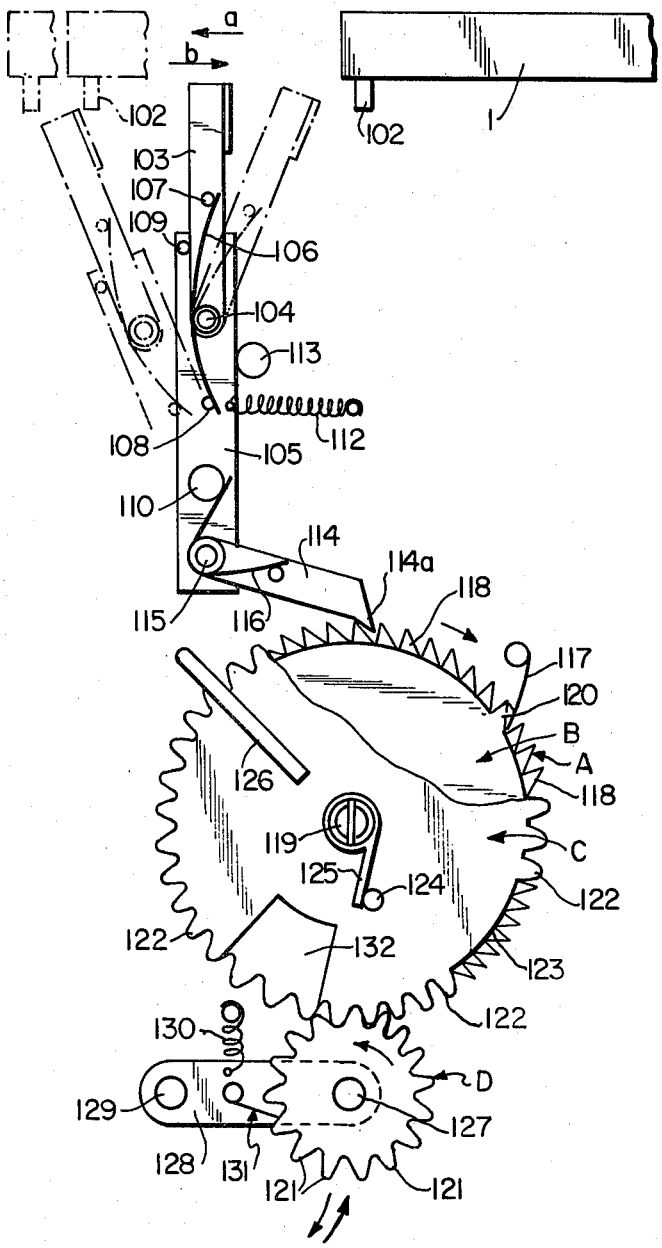
FIG. 6 is a detailed front view of a further feature of FIG. 1.
Figure 7:
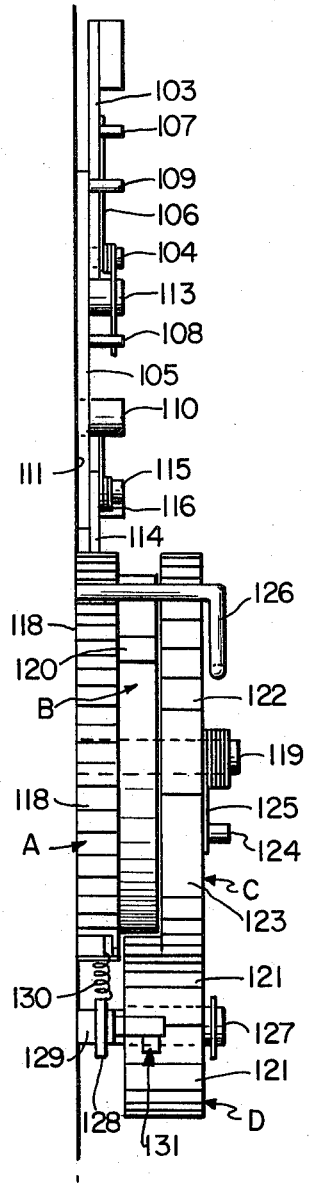
FIG. 7 is a side view as seen from the left of FIG. 6.

As shown in FIG. 6 and FIG. 7, a projection 102 protrudes from the lower end part of table 1. A count lever 103 abuts against projection 102 during reciprocating motion of table 1, and lever 103 is pivoted to a plate member 105 by a pivotal shaft 104. A spring 106 urges count lever 103 in a counterclockwise direction around pivotal shaft 104 by contact with spring holders 107 and 108 protruding from count lever 103 and plate member 105, respectively. A stopper 109 protrudes from plate member 105 to limit the turning of count lever 103 in the counter-clockwise direction around pivot shaft 104. A pivotal shaft 110 mounts pivot plate member 105 to machine frame 111, and a tension spring 112 urges plate member 105 around pivotal shaft 110 in the clockwise direction. A stopper 113 protrudes from machine frame 111 to limit the turning of plate member 105 around pivotal shaft 110 in the clockwise direction from the position shown by solid lines in FIG. 6. An advancing nail or cog 114 pivoted on plate member 105 through pivotal shaft 115 has a tip end 114*a* meshed with gear A to turn gear A by one pitch when plate member 105 turns around pivotal shaft 110 in the counterclockwise direction. A spring 116 urges cog 114 around pivotal shaft 115 in the clockwise direction, and a ratchet mechanism 117 prevents turning of gear A in the reverse direction.

Gear A is provided with a prescribed number of saw edge shaped teeth 118, and gear A is pivoted by pivotal shaft 119 protruding from machine frame 111. Gear B is positioned so as to turn around pivotal shaft 119 and has only one tooth 120 thereon. A gear D is provided with a plurality of teeth 121 therearound, and teeth 121 mesh with tooth 120 on gear B and teeth 122 on a gear C to be described in more detail below. Since gear B has only one tooth 120, gear D is turned one pitch for each revolution of gear B. Gear C has plural teeth 122 provided therearound, and gear C meshes with gear D. Therefore, gear C is turned one pitch through gear D as gear B rotates one complete revolution. There is a portion 123 on gear C where no teeth are provided, and when portion 123 comes to a position opposed to gear D, gear C is not turned even when gear D is turned, since gears C and D do not mesh at portion 123. A projection 124 is provided on gear C, and projection 124 gradually pushes return spring 125 during rotation of gear C. Therefore, when gear D is released from meshing with gear C, gear C is turned in the counterclockwise direction by return spring 125 up to a position where projection 124 abuts against a stopper 126 protruding from maching frame 111 (i.e. starting position). In order to release gear D from meshing engagement with gear C, a plate member 128 supporting pivotal shaft 127 of gear D is pivoted around pivotal shaft 129 protruding from machine frame 111 in the clockwise direction in FIG. 6. This pivoting is to be performed in accordance with an operation of exchanging master paper. That is, plate member 128 and gear D are turned around pivotal shaft 129 in the clockwise direction in cooperation with the operation of the automatic master paper exchanging operation by depressing the operating push button of the automatic master paper exchanging apparatus. A spring 130 urges gear D into meshing engagement with gear C, and a ratchet mechanism 131 prevents gear D from turning in the clockwise direction. An indicator 132 indicates that it is time to exchange master paper. Indicator 132 is on gear C and is seen from outside the machine body in accordance with the position of turning of gear C and indicates that more than the prescribed number of copying operations have been carried out on the master paper.

Figure 8:
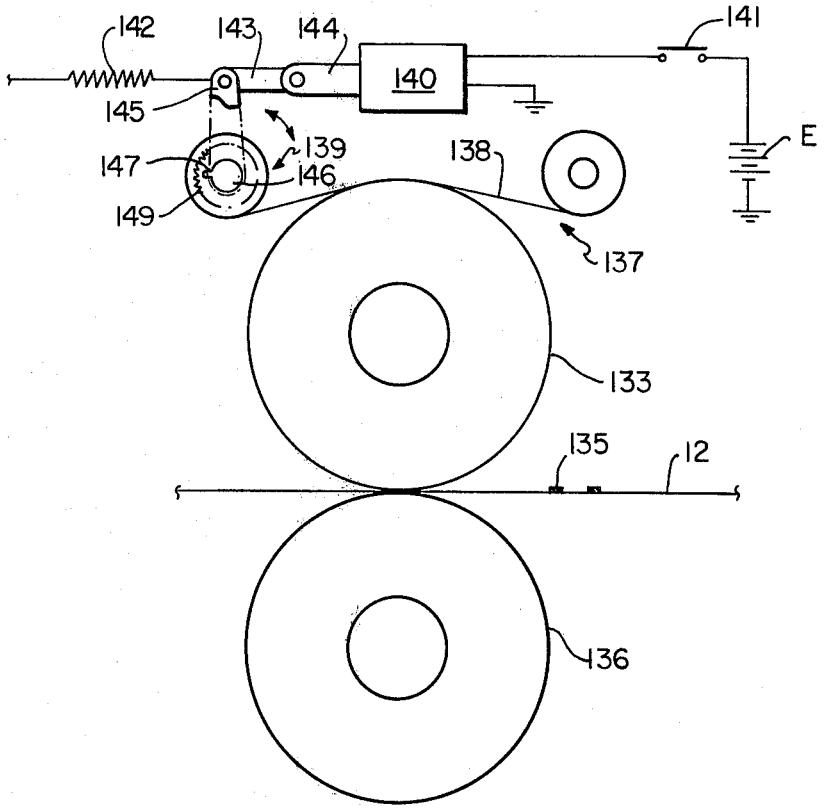
FIG. 8 is a schematic view of a fixing roller cleaning apparatus.

FIG. 8 shows an apparatus for cleaning the fixation roller of the electrostatic photographic copying machine. A fixation roller 133 fixes toner 135, attached to transfer paper 12 by transfer apparatus 5, onto paper 12 by pressing and heating. A roller 136 pinches paper 12 together with fixation roller 133. Cleaning apparatus 137 is wound in roll form, and includes a silicon cloth 138 one part of which contacts the outer peripheral surface of fixation roller 133. Winding tubular body 139 winds up silicon cloth 138, and electromagnetic solenoid 140 controls winding tubular body 139. Switch 141 is closed automatically to energize electromagnetic solenoid 140 when counting lever 103 has been operated to count that a predetermined number of copying operations have been performed. When counting lever 103 counts that the predetermined number of copying operations has been performed, switch 141 is closed. As one example, the arrangement may be such that a microswitch provided adjacent gear B is closed by tooth 120 of gear B. In this case, since gear B has only one tooth, the microswitch is closed one time by tooth 120 for every revolution of gear B. Electromagnetic solenoid 140 acts to pull rods 143 and 144 to the right in FIG. 8 against the tensile force of spring 142 and turns lever 145 in the clockwise direction around pivotal shaft 146 when it is energized by the closing of switch 141. Lever 145 is returned to its original position by the tensile force of spring 142 when switch 141 is opened. An engaging nail or cog 147 is pivoted on pivotal shaft 146 and is engaged with saw edge shaped teeth 149 formed on the inner peripheral surface of tubular member 139. When pivotal shaft 146 is turned in the clockwise direction by electromagnetic solenoid 140, engaging cog 147 is also turned with pivotal shaft 146, and tubular member 139 is thereby turned by one pitch in the same direction. When pivotal shaft 146 is turned in the counterclockwise direction and returned to its original position by the force of spring 142, engaging cog 147 is separated from the tooth 149 with which it was engaged and then is engaged with the nexth tooth 149. Thereafter, the same motion is repeated. Thus, by repetition of "ON" and "OFF" operation of switch 141, tubular body 139 rotates only in the clockwise direction when switch 141 is opened, and tubular body 139 successively winds up silicon cloth 138, whereby new portions of silicon cloth 138 contact the outer peripheral surface of fixation roller 133. In FIG. 8, E is an electric source.

In the above construction, as a copying operation is started, table 1 mounting thereon an original is reciprocated. As table 1 is moved in this case from the position shown by the solid lines in FIG. 6 in the direction of arrow a, counting lever 103 is pushed by projection 102 and tends to turn in the counterclockwise direction around pivotal shaft 104. But counting lever 103 and plate member 105 are turned as one body around pivotal shaft 110 in the counterclockwise direction since motion of counting lever 103 is obstructed by stopper 109. Thus, advancing cog 114 turns gear A by one pitch. As table 1 has moved to the position shown by the phantom lines in FIG. 6 and the abutment of projection 102 against counting lever 103 has been released, plate member 105 and counting lever 103 are returned back to a position shown by the solid lines by the action of tension spring 112. Next, when table 1 is moved in the direction of arrow b from the leftmost position shown by the phantom lines, projection 102 turns counting lever 103 around pivotal shaft 104 in the clockwise direction. However, plate member 105 is not turned since turning thereof in the clockwise direction is obstructed by stopper 113. When abutment between counting lever 103 and projection 102 has been released, counting lever 103 is returned back to the original position shown by the solid lines in FIG. 6 due to the energizing force of spring 106. Thus, when counting lever 103 is turned together with plate member 105 in the counterclockwise direction around pivotal shaft 110 from the position shown by the solid lines in FIG. 6, advancing cog 114 turns gear A by one pitch in the clockwise direction. On the other hand, when counting lever 103 is turned in the clockwise direction around pivotal shaft 104, gear A is not turned. Therefore, when one copying operation is performed and table 1 performs one reciprocating motion, gear A is turned by one pitch.

When the required number of copying operations is performed, gear A is turned a corresponding number of pitches, and gear B having only one tooth 120 is also turned with gear A. Therefore, when gear A turns by 360° (i.e. on revolution), gear D meshed with gear B turns by one pitch, and gear C meshed with gear D also turns by one pitch. Thus, gear C is turned corresponding to each copying process, whereby when more than a prescribed number of copying operations are performed, it becomes possible to detect indicator 132 from outside the machine body, and it can be determined that it is time to exchange master paper.

When an operation to exchange master paper is performed, plate member 128 is turned in the clockwise direction around pivotal shaft 129 in accordance with the exchanging operation as described above, and meshing between gear D and gear C is released. Therefore, gear C is turned in the counterclockwise direction by returning spring 125 up to a position (i.e. the starting position) where projection 124 abuts against stopper 126.

When counting lever 103 counts that the predetermined number of copying operations has been performed, switch 141 is closed and electromagnetic solenoid 140 is energized, whereby silicon cloth 138 is wound up by winding tubular body 139, and a new portion of silicon cloth 138 is contacted with the outer peripheral surface of fixation of roller 133.

The present invention includes the above construction of a gear provided with an indicator which turns corresponding to each copying process so as to indicate the time for exchanging master paper. Thus, the time for exchanging master paper can be known easily and surely. Moreover, the gear provided with the indicator is formed to return to the original position in accordance with the operation of exchanging master paper. Thus, operation and handling of the apparatus is very simple. The cleaning cloth is replaced by the driving cleaning apparatus when a predetermined number of copying operations has been completed by cooperation of the counting mechanism and the fixing roller cleaning apparatus. Accordingly, the fixing roller can always be maintained in a non-contaminated condition, and clear copies can always be provided.

Separating Apparatus for Transfer Paper

Figure 9:
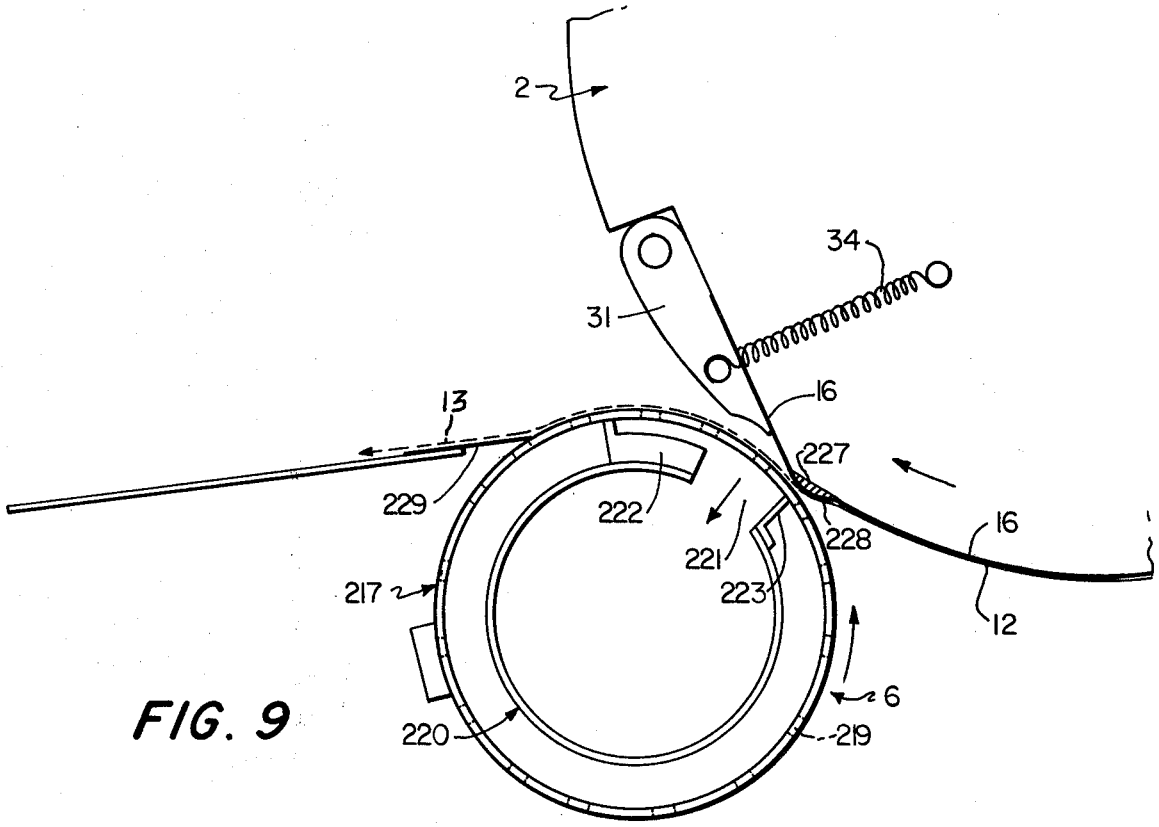
FIG. 9 is a schematic view of a separating apparatus.

FIG. 9 shows in detail the transfer paper separating apparatus 6. A suction type separating drum 217 separates transfer paper 12 from master paper 16. Separating drum 217 is arranged at a position spaced by a prescribed distance from the surface of master holding body 2. Separating drum 217 has a plurality of holes 219 in the peripheral surface thereof, and is rotatably supported. A suction cylinder 220 is fixedly positioned within drum 217. Suction cylinder 220 is provided with a suction port 221 at a prescribed position, and atmosphere is sucked in from a required number of holes 219 outside separating drum 217 through suction port 221. Transfer paper 12 on master paper 16 is separated from the master paper 16 by such suction. 222 and 223 are rubber seal members. Elastic member 227 consisting of sponge material is provided on the surface of master holding body 2 in an expanded state, thereby forming an elastic expanded part 228 on master paper 16 which is attached onto the surface of master holding body 2. This expanded part 228 is positioned to be at the tip end part of transfer paper 12 on master paper 16. When transfer paper 12 is advanced to separating apparatus 6 and is sucked toward separating drum 217 away from master paper 16, separation of the tip end of transfer paper 12 from master paper 16 becomes easy due to expanded part 228. Accordingly, transfer of the tip end part of transfer paper 12 onto separating drum 217 is performed rapidly, and as a result, not only separation of the transfer paper is performed easily and surely, but also the suction force required of drum 217 is reduced. Transfer paper 12 transferred onto separating drum 217 moves with rotation of drum 217. Then transfer paper 12 is scraped from the drum 217 by scraping member 229 provided at the side of transfer paper carrying passage 13. The transfer paper then is carried out of the machine body through fixation apparatus 14.

Although elastic member 227 is provided on the peripheral surface of master holding body 2 to form expanded part 228 of master paper 16 in the above specific embodiment, an expanded part having a gap in the master paper 16 itself may be formed without specifically providing such elastic member.

As explained above, the transfer paper separating apparatus according to the present invention is formed such that an elastic expanded part is provided on the master paper at the position of the tip end part of the transfer paper on the master paper, and the transfer paper is separated by cooperation of suction from the separating drum and the elastic expanded part. Accordingly, separation of the transfer paper from the surface of the master holding body is performed easily and surely.

Toner Supply Control Apparatus

Figure 10:
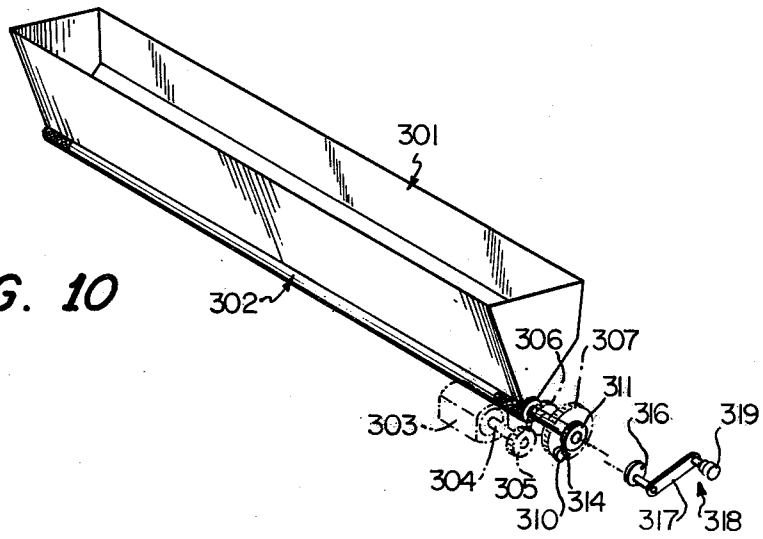
FIG. 10 is a perspective view of a toner supply and toner supply control apparatus.
Figure 11:
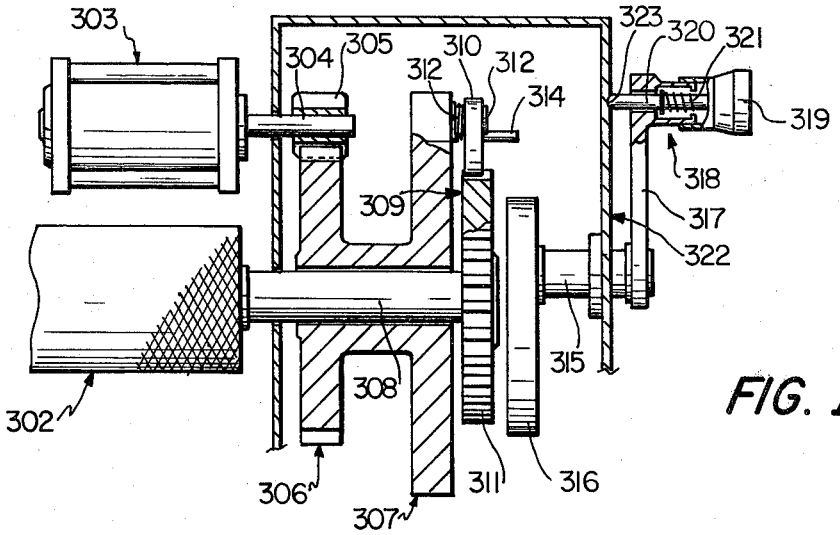
FIG. 11 is an enlarged partial front view of the toner supply control apparatus of FIG. 11.

FIG. 10 shows a toner supply device and a control apparatus for controlling the supply of toner from the supply device, as used in development apparatus 4, and FIG. 11 shows the control apparatus in detail. The toner supply device includes toner supply hopper 301, and knurled roller 302 supported by a shaft at the lower end of hopper 301. Toner thrown into hopper 301 is supplied from the lower end thereof in accordance with rotation of knurled roller 302, and no supply of toner is performed when roller 302 does not rotate.

In FIG. 11, 303 is a driving motor, and driving gear 305 is fixed to output shaft 304 of motor 303. Gear 305 meshes with intermediate transmitting gear 306. Disc 307 is coaxially connected with intermediate transmitting gear 306 to form a unitary body, and gear 306 and disc 307 are loosely fitted on rotary shaft 308 of knurled roller 302. Ratchet mechanism 309 includes cog 310 and cog-wheel 311. Cog-wheel 311 is fixed at the outer end of rotary shaft 308 of roller 302, and cog 310 normally engages with cog-wheel 311 due to the force of spring 312 inserted between cog 310 and disc 307. Pin 314 is provided on cog 310, and pin 314 slidably contacts a peripheral edge part of an elliptic-shaped eccentric cam 316 fixed to one end of shaft 315 which is supported at a position eccentric to rotary shaft 308 of roller 302. Lever 317 is fixed to the other end of shaft 315, and engaging means 318 is provided to fix the position of cam 316. Engaging means 318 includes a rod 320 having at the outer end thereof a knob 319 and inserted slidably into an end part of lever 317. Spring 321 is inserted between a flange of rod 320 and lever 317. The other end of rod 320 is urged into engaging holes 323 arranged at spaced relation on the periphery of casing 322 by spring 321, to thereby fix the position of lever 317 and cam 316. Thus, lever 317 and engaging means 318 form an operating member to adjust the position of cam 316.

Figure 12A:
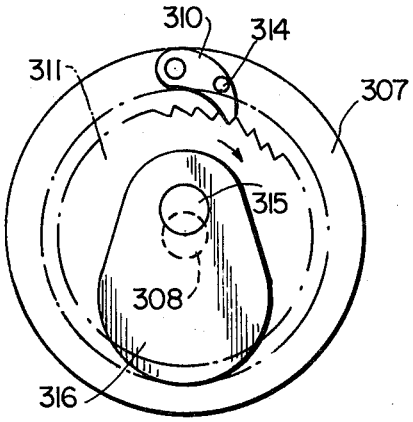
FIGS. 12*a–c* are schematic views showing alternative control positions of the toner supply control apparatus in FIG. 11.
Figure 12B:
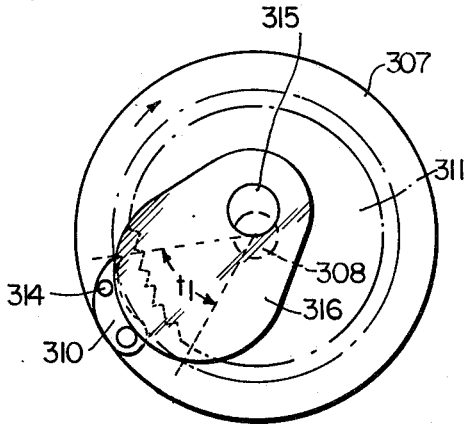
Figure 12C:
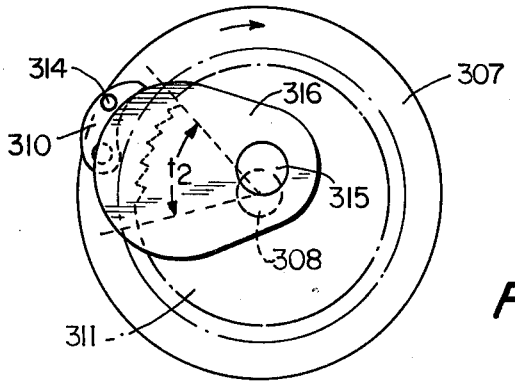
Figure 13:
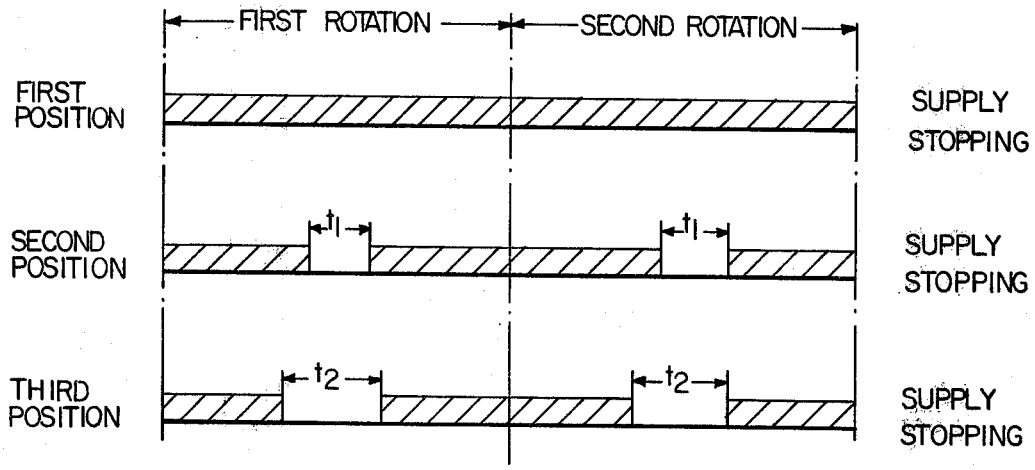
FIG. 13 is a sequence timing graph illustrating the supply conditions of the positions in FIGS. 12*a–c;*

FIGS. 12*a*, 12*b* and 12*c* are side views showing different operating positions of the toner supply control apparatus, and particularly the motion of ratchet mechanism caused by changes of position of the cam. It is assumed that disc 307 is rotating at a constant velocity by operation of driving motor 303. FIG. 12*a* shows the situation where cam 316 is set at a first position whereat cog 310 and cogwheel 311 are always engaged since pin 314 is not in contact with cam 316. Accordingly, knurled roller 302 is continuously rotated, and a maximum quantity of toner is supplied. FIG. 12*b* shows the situation where cam 316 is moved by rotation to a second position whereat pin 314 contacts the peripheral edge part of cam 316 during period $t_1$, whereby cog 310 is separated from cog-wheel 311. Thus, rotation of knurled roller 302 is stopped and toner is not supplied during the period $t_1$, whereby the quantity of toner being supplied is reduced overall. FIG. 12*c* shows the situation where pin 314 contacts with cam 316 during a longer period of time than the case of FIG. 12*b*, and cog 310 is separated from cog-wheel 311 during period $t_2$. ($t_2 > t_1$), and accordingly the overall quantity of toner being supplied is reduced even more. By properly adjusting the position of cam 316 in the manner discussed above, the quantity of toner being supplied can be controlled at will. FIG. 13 shows the state of toner supply at each position of cam 316 with respect to the conditions of FIGS. 12*a–c*.

Further, the period of contact between the cog and cog-wheel can be changed by changing the shape of the cam.

As explained above, in the present invention, since a ratchet mechanism is inserted between the driving source and toner supply means, and a cam is provided to control the period of engagement of the ratchet mechanism, a further device to adjust the position of the cam is provided, such that the quantity of toner being supplied can be adjusted at will by operating of such device. Since a cam is used construction is simple and minute adjustment is possible.

Transfer Apparatus

Figure 14:
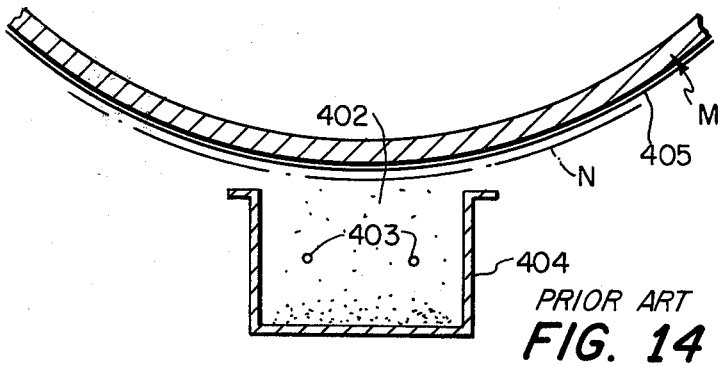
PRIOR ART FIG. 14
FIG. 14 is a cross-sectional view of a conventional transfer apparatus.

A customary transfer apparatus includes a shield casing 404 having an opening 402 facing master holding body M and having therein, e.g. two fine wires 403 for corona discharge as shown in FIG. 14. However, this apparatus has the defect that toner or iron powder adhered to master paper 405 on the peripheral surface of master holding body M falls into shield casing 404 and adheres to the bottom wall when, e.g., transfer paper N is not passing through the space between said shield casing 404 and master holding body M. Thus, not only does the discharging effect become inferior, but also there is the danger of the occurrence of abnormal discharge.

In this invention, it is possible to prevent the above disadvantages.

Figure 15:
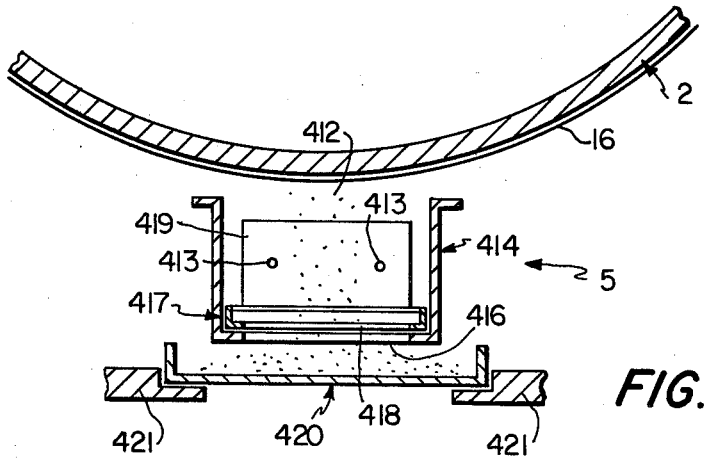
FIG. 15 is a cross-sectional view of a transfer apparatus according to one practical embodiment of the present invention.
Figure 16:
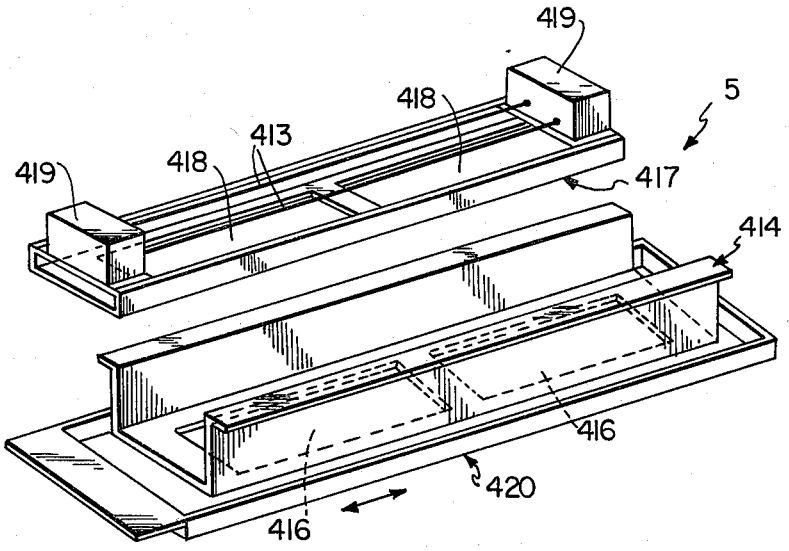
FIG. 16 is a perspective exploded view of the transfer apparatus in FIG. 15.

FIG. 15 and FIG. 16 show one practical example of a transfer apparatus 5 according to the present invention. A shield casing 414 is formed as a substantially channel-shaped member having an opening 412 facing master holding body 2 and provided with further openings 416 on the bottom wall of this casing 414 so as to face opening 412. A cursor 417 of substantially shallow channel-shaped section is fitted and slidably arranged within shield casing 414 and has openings 418 formed in its bottom wall so as to face openings 416 on the bottom wall of shield casing 414. Bases 419 are attached to opposite ends of cursor 417, and two fine wires 413 for corona discharge are extended in parallel between bases 419. Shield casing 414 is removably supported by a supporting frame (not shown). A toner receiver 420 is arranged at a position spaced below shield casing 414 so as to face openings 416. Toner receiver 420 is formed as a substantially shallow channel-shaped member which is wider than shield casing 414 and is supported by frames 421 provided on the machine body so as to be slidable along the lengthwise direction of shield casing 414 and to be removable from frames 421. By such a transfer apparatus, even if toner or iron powder falls from master paper 16 on the peripheral surface of mastering holding body 2, it is not accumulated within shield casing 414. Rather, such fallen toner is received by toner receiver 420 below shield casing 414. Toner accumulated within receiver 420 may be cleaned therefrom by removing the receiver 420 from the machine at the proper time.

Figure 17:
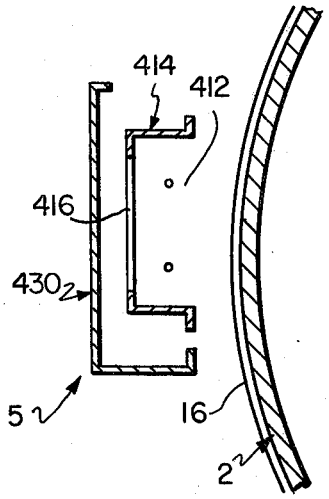
FIG. 17 is a cross-sectional view of a transfer apparatus according to another practical embodiment of the present invention.

In the above practical example, shield casing 414 is arranged under master holding body 2, i.e. opening 412 of shield casing 414 faces upwardly. However, in the practical example in FIG. 17, shield casing 414 is arranged on the side of master holding body 2, and opening 412 faces laterally. Toner receiver 430 has, e.g., a substantially L-shaped section and is arranged outside of shield casing 414. Receiver 430 may be slidably and removably supported by a supporting frame in a manner similar to that described above with reference to FIG. 16. Accordingly, toner etc. scattered from master paper 16 of master holding body 2 passes through openings 416 at the outside of shield casing 414 and is caught by receiver 430.

In either of the above two practical examples, toner receiver 420 or 430 is necessarily spaced from shield casing 414, since when it is positioned too close to casing 414, abnormal discharges are apt to cccur, while when it is positioned too far from casing 414, toner etc. does not reach the receiver but rather is scattered around the photo-sensitive element and the effect of the receiver is eliminated. The spacing distance may be properly determined by, e.g., the voltage to be applied to the transfer apparatus.

It is desirable to use conductive metals for the shield casing and the toner receiver according to the present invention.

As explained above, in the transfer apparatus according to the present invention, the shield casing has an opening in the side facing the master holding body and at least one other opening in the opposite side, and a toner receiver is provided at a position properly spaced outwardly from the latter opening. The receiver is removably supported in relation to the machine body, and toner or iron powder etc. from the master paper is caught by the receiver without adhering to the shield casing. Thus, inferior discharge effect and the occurrence of abnormal discharge is obviated, and toner etc. caught by the receiver can be cleaned simply by removing the receiver from the machine body. Thus, the apparatus is very convenient, and also the life of the transfer apparatus can be prolonged.

Apparatus for Detecting Jamming of Paper

In a customary apparatus for detecting jamming of paper in an electrostatic photographic copying machine, a cam to be rotated coaxially with the master holding body is provided, and two microswitches, i.e. a first microswitch to be closed or opened ("ON" or "OFF") by abutting against the cam and a second microswitch installed on the transfer paper carrying passage in order to detect the arrival of the transfer paper, have been provided. The time from starting of a copying operation to "ON" of the first microswitch and the second microswitch has been measured, and the range of paper jamming has been set to correspond to this time. Thereby, paper jamming may be detected when the second microswitch is not put to "ON" within such set range. This type of arrangement may be used when the master holding body rotates one time every copying operation. However, in a machine of the type such that the master holding body is rotated several times after the performance of one time copying for the purpose of cleaning of the master holding body there is the inconvenience that paper jamming signal alarms occur, even when paper jamming does not occur, since the first microswitch repeats several times the "ON"-"OFF" operation for every copying operation.

The present invention provides a paper jamming detecting apparatus wherein these inconveniences are overcome.

Figure 18:
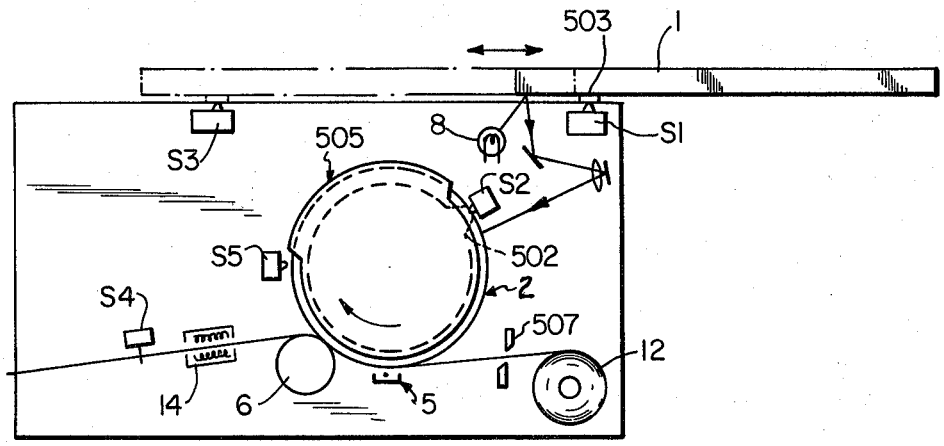
FIG. 18 is a schematic view of a paper jamming apparatus according to the invention.
Figure 19:
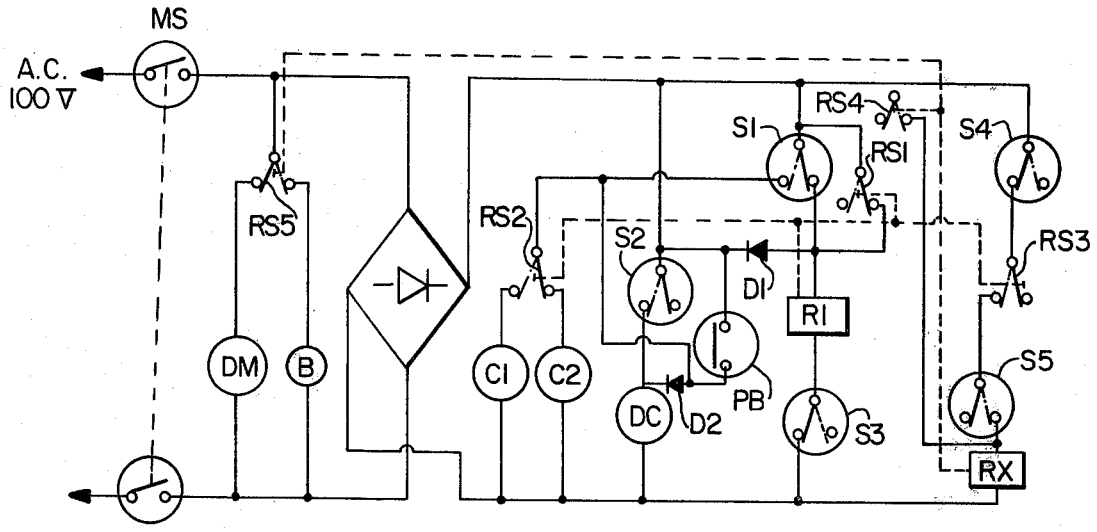
FIG. 19 is an electric circuit diagram of the apparatus of FIG. 18.

FIG. 18 shows the main parts of the electrostatic photographic copying machine, with the original paper mounting table 1 adapted to be moved to the right and left, by means of driving motor DM and electromagnetic clutches C1 and C2 shown in FIG. 19. S1 is a microswitch to be put to "ON" when pushed by projection 503 provided on original paper mounting table 1 when original paper mounting table 1 is in its starting position, i.e. the solid line position in FIG. 18. S3 is a microswitch to be put to "ON" when original paper mounting table 1 has been moved leftward from the starting position to a prescribed position. S3 constitutes a first detector. 502 and 505 are cams mounted to be rotated coaxially with master holding body 2, and microswitches S2, S5 are provided so as to contact cams 502 and 505 respectively. Microswitch S5 constitutes a second detector to detect the amount of rotary movement of master holding body 2. 507 is a cutter which cuts transfer paper 12, and S4 is a microswitch provided on the transfer paper carrying passage at a position behind fixation apparatus 14. S4 constitutes a third detector to detect existence of transfer paper.

Figure 20:
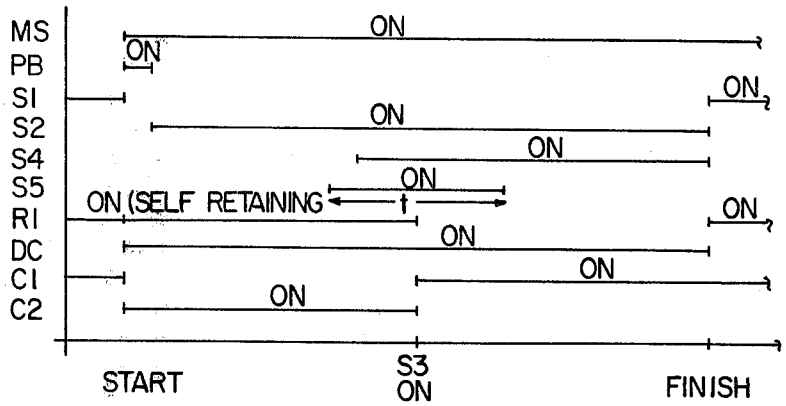
FIG. 20 is a time chart illustrating the operation of the circuit of FIG. 19.

Next, the operation of the paper jamming detecting apparatus will be explained referring to the electric circuit diagram shown in FIG. 19 and the time chart shown in FIG. 20.

First, main switch MS is closed, and an original paper is set on original paper mounting table 1 positioned at the starting position thereof, i.e. the solid line position in FIG. 18.

When original paper mounting table 1 is in the starting position, microswitch S1 is "ON", and relay R1 is energized. At this time, microswitch S3 is in the state shown by the solid line. Then, relay contact RS1 of relay R1 is held in the position shown by the solid line and relay R1 is made self-retaining. Relay contacts RS2 and RS3 are also held in their respective solid line positions.

Next, when starting push button PB for a copying operation is depressed, electromagnetic clutch DC for driving master holding body 2 is actuated by contact of push button PB through diode D2, and master holding body 2 is rotated in the direction of the arrow in FIG. 18 by driving motor DM which is energized through relay contact RS5. Cam 502 releases contact with microswitch S2 just after starting of rotation of master holding body 2, and microswitch S2 is put to "ON", i.e. the position shown by the phantom line. Then, since electromagnetic clutch DC is energized through microswitch S2 even if button PB is released, master holding body 2 continues its rotation. On the other hand, electromagnetic clutch C2 for leftward movement of original paper mounting table 1 is also energized through relay contact RS1, diode D1, push button PB and relay contact RS2 by depressing push button PB, and thereby original paper mounting table 1 starts its leftward movement. Since microswitch S1 becomes "OFF" with this leftward movement and its contact is changed to the position shown by the phantom line, energizing of electromagnetic clutch C2 is continued even if its contact is opened by release of push button PB. Thus, leftward movement of original paper mounting table 1 and rotation of master holding body 2 are performed and copying is started. When master holding body 2 rotates by a predetermined angle, microswitch S5 is put to "ON" during prescribed time t by pushing of cam 505. Also, transfer paper 12 is fed synchronously in cooperation with the rotation of master holding body 2 and copying is performed on transfer paper 12 by transfer apparatus 5, separating apparatus 6 and fixation apparatus 14 during movement of transfer paper 12 along its carrying passage. When microswitch S4 is put to "ON" by detecting a fed transfer paper 12, its contact is changed to the position shown by the phantom line. And, when original paper mounting table 1 has come to the position shown by the phantom line in FIG. 18, microswitch S3 is put to "ON" and its contact is changed to the state shown by the phantom line, and energizing of relay R1 is cut off. Then, contacts RS1, RS2 and RS3 are changed to the positions shown by the respective phantom lines. Then, since microswitch S1 is put to "OFF" and its contact is changed to the position shown by the phantom line at the start of leftward movement of original paper mounting table 1, electromagnetic clutch C1 is energized through S1 and RS2, and now original paper mounting table 1 starts rightward movement. When table 1 returns to the position shown by the solid line in FIG. 18, microswitch S1 is put to "ON" and relay R1 is energized. Further, microswitch S3 is put to "ON" and its contact is changed to the position shown by the solid line just after starting of rightward movement of original paper mounting table 1. Hence, relay contacts RS1, RS2 and RS3 are changed again to the positions shown by the respective solid lines. Further, since contact of microswitch S1 is at the solid line position and contact of push button PB is also opened even when relay contact RS2 is changed to the solid line position, electromagnetic clutch C2 is not energized, and original paper mounting table 1 is stopped at the solid line position in FIG. 18, unless push button PB is again depressed.

When microswitch S4 detects no transfer paper 12 due to jamming of the transfer paper, i.e. such that no transfer paper 12 is fed and the contact of microswitch S4 is at the solid line position, microswitch S3 is "ON" due to leftward movement of original paper mounting table 1 within time t at which microswitch S5 is to be put to "ON" (see FIG. 20), relay RX is energized through microswitch S4, relay contact RS3 and microswitch S5. Then relay contact RS4 is changed to the phantom line position, relay RX is made self-retaining through relay contact RS4, and relay contact RS5 is also changed to the phantom line position. Thus, energizing of driving motor DM is cut off, and alarming buzzer B is energized to alert the copying operator that paper jamming has occurred. On the other hand, when transfer paper is fed smoothly, since microswitch S4 is put to "ON", and microswitch S3 is put to "ON" as original paper mounting table 1 moves to the leftward endmost position, and microswitch S5 of master holding body 2 is put to "ON", alarming buzzer B is not energized. Thus, even when master holding body 2 is rotated again for the purpose of cleaning after transfer paper 12 has been discharged, there is no possibility of occurrence of mistaken alarm, since original paper mounting table 1 is stopping at the starting position and microswitch S3 is not operated.

In a customary apparatus, when the master holding body is rotated several times after a copying rotation for the purpose of cleaning, the positions of the master holding body and the transfer paper are identical to those in the situation where no transfer paper is fed regardless of rotation of the master holding body (i.e. a paper jamming condition), and the alarming buzzer is energized. Thus, such conventional detecting apparatus could not be used for such type of copying machine.

Further, in the above practical example, although explanation was made based on a type of copying machine wherein the original paper mounting table moves while the optical device is stationary, it will be obvious that in the type of copying machine wherein the optical devices moves while the original paper mounting table is stationary, paper jamming can be detected in accordance with the above practical example of the invention by providing the first detector at a position where the amount of movement of the optical device can be detected.

The paper jamming detecting apparatus according to the present invention includes a first detector to detect the amount of movement from a starting position of the original paper mounting table, and a second detector to detect the amount of rotary movement of the photographic drum, a third detector positioned downstream of the fixing assembly to detect the existence of transfer paper, and an electric circuit to send a paper jamming signal when the first detector and the second detector are detecting normally and the third detector detects the absence of transfer paper. Thus, paper jamming is detected by three occurrences, such as movement of the original paper mounting table, rotation of the master holding body and existence of transfer paper. Accordingly, when a disposal apparatus containing, e.g., a charging-exposing device and a development means is arranged along the course of movement of the transfer paper, each device can be controlled in conjunction with a copying operation such that the charging device can be used for charging and transferring, and the development device can be used for development and cleaning. Thereby, even when the apparatus is used for a copying machine constituted such that n number of copies are made during 2n+1 rotations of the master holding body during a copying operation, paper jamming can be detected exactly, and also the apparatus can be controlled so as to not emit mistaken alarms.

Magnetic Brush Development Apparatus

In general, a magnetic brush development apparatus is provided with a device for supplying toner, a rotary sitrring body for stirring and mixing toner and carrier, and a magnetic brush roller. However, in such conventional apparatus, since the rotary stirring body is constructed by arranging a plurality of elongated plate-shaped stirring blades substantially throughout the entire length of the rotary shaft thereof, the disadvantage occurs that, when the end portion of each of the blades is set adjacent the side wall of the development apparatus, the resistance due to the side wall is increased during stirring, and thereby the developer being stirred is whirled up as smoke, is adhered to unnecessary parts of the magnetic brush roller, or leaks out and taints the circumference. On the other hand, when the end portion of each of the blades is set sufficiently apart from the side wall, the developer interposed between the end portion of the blades and the side wall is not subjected to stirring and accordingly stagnates, and the effect of stirring is extremely reduced.

In the magnetic brush development apparatus according to the present invention, the longitudinal middle portion of the stirring body is formed with stirring blades and both the end portions thereof are formed in a spiral body in a shape to convey developer toward such middle portion.

Figure 21:
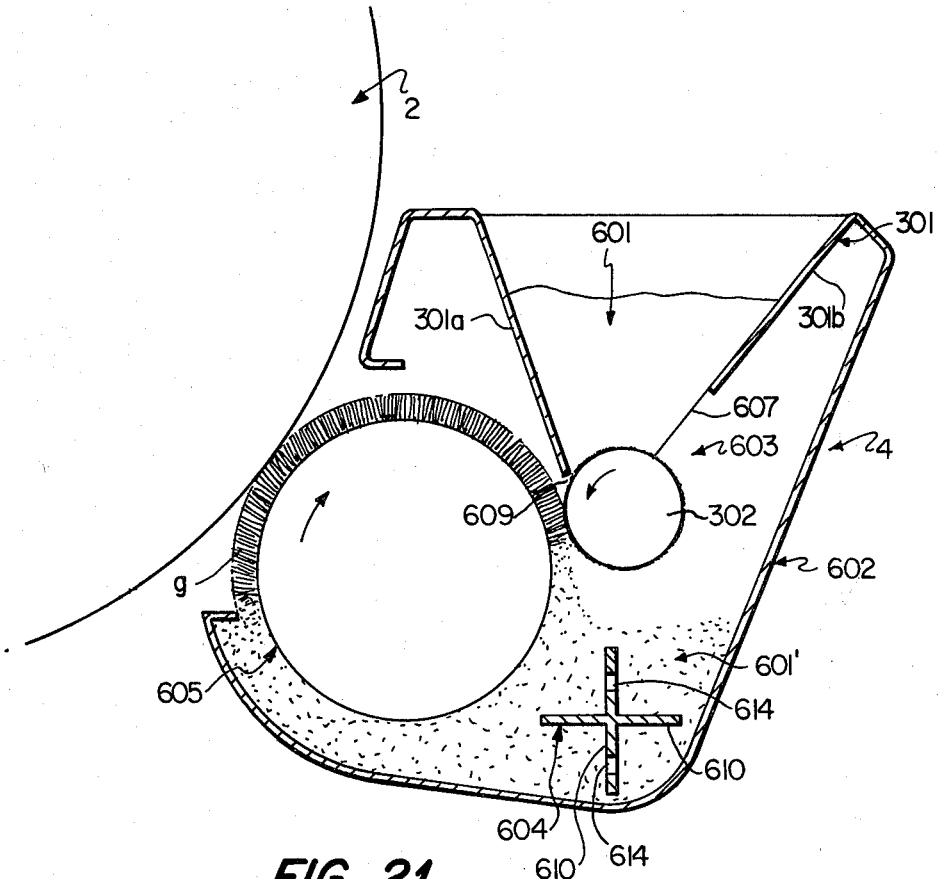
FIG. 21 is a sectional side view of a magnetic brush development apparatus according to the invention.

FIG. 21 shows the magnetic brush development apparatus 4 according to the present invention, and this development apparatus includes means 603 for supplying a predetermined quantity of toner 601 into a vessel 602, a rotary stirring body 604 for stirring and mixing the developer 601' consisting of carrier and toner 601, and a magnetic brush roller 605 forming magnetic brush g on the peripheral surface thereof by scooping up the stirred and mixed developer 601' in the vessel 602.

Toner supply means 603 comprises hopper 301 formed of a pair of inclined plate-type hopper members 302*a* and 301*b*, an oscillation plate 607 provided at the lower end portion of the hopper member 301*b*, and knurled roller 302 provided at the lower portion of the oscillation plate and the other hopper member 301*a*. The lower end of the oscillation plate 607 contacts the knurling on the peripheral surface of the knurled roller 302 and is oscillated according to the rotation of the roller 302. The toner 601 supplied into the hopper 301 is rocked by the oscillation of the oscillation plate 607 caused by the rotation of the knurled roller 302 and is dropped downward from a supply port 609 between the hopper member 301*a* on the side opposite to the oscillation plate 607 and the peripheral surface of the roller 302 in a predetermined quantity.

Figure 23:
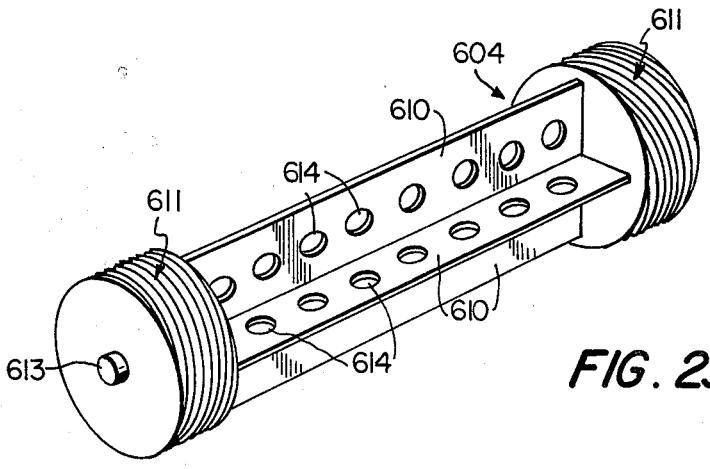
FIG. 23 is a perspective view of the rotary stirring body of FIG. 22.
Figure 22:
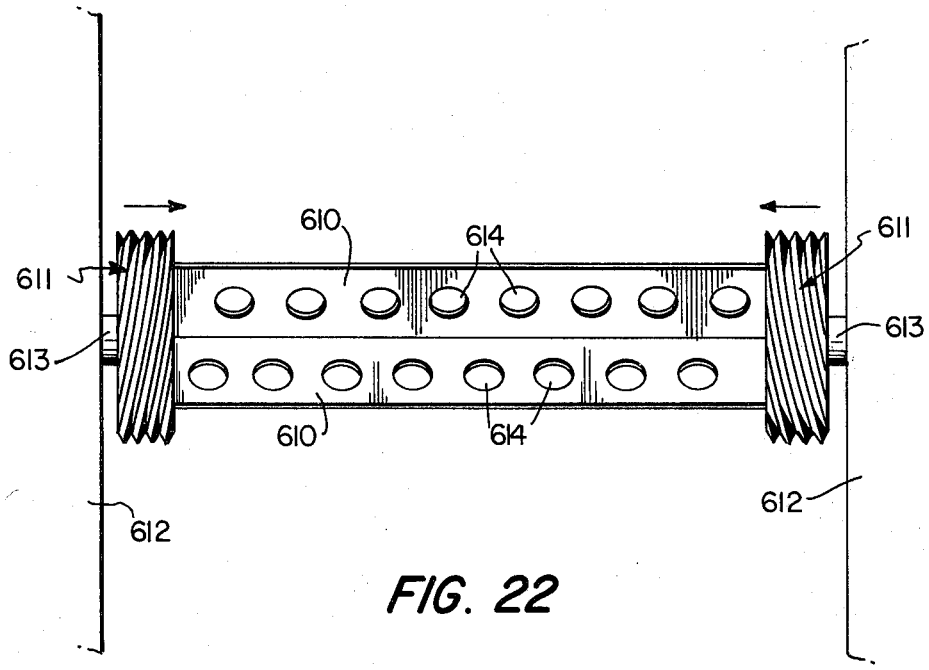
FIG. 22 is a front view showing the rotary stirring body in the apparatus of FIG. 21.

As is apparent from FIGS. 22 and 23, the rotary stirring body 604 includes a longitudinal middle portion which is cross-shaped in section and which is formed by four plate-shaped stirring blades 610. Body 604 further includes end portions formed by spiral bodies 611 fixed to opposite ends of stirring blades 610 and attached to rotary shafts 613 supported by the side walls 612. Body 604 is rotated by the rotation of one shaft 613 driven by a driving gear (not shown). The spiral bodies 611 have spiral grooves threaded in opposite directions to each other. Thereby, when the stirring body 604 is rotated, the grooves in each of the spiral bodies 611 are directed toward the stirring blades at the middle portion of the body. In each of the stirring blades 610 are provided a plurality of through-holes 614, and as is apparent in FIG. 22, the through-holes in one blade 610 and those in an adjacent blade 610 are arranged in an offset manner zig-zag to each other.

When stirring body 604 is used during the stirring and mixing of developer 601', the developer near a side wall 612 is stirred and mixed while being induced toward the middle portion of the stirring body 604 by the rotation of the respective spiral body 611. Thus, the developer does not remain stagnated near the side wall and conversely, the developer is not blown upwardly due to the resistance of the side wall. The developer in the middle portion and the toner and carrier of the developer having been transferred from both ends are stirred and mixed uniformly by the blades 610. However, the toner and carrier pass through the through-holes 614 provided in each of the blades 610, so that the developer is not scattered upwardly, and smooth stirring is achieved while an effective mixing operation is performed.

As described above, in the magnetic brush development apparatus according to the present invention, the longitudinal middle portion of the rotary stirring body is formed with stirring blades, and both the ends thereof are formed with spiral bodies of a shape for moving developer toward the middle portion. Thus, as compared with a conventional device, the developer near the side walls is never moved upwardly as smoke due to the resistance of the side wall, nor is it hardened without being stirred. Rather, the developer near the side walls is induced and transferred to the middle portion by the spiral bodies, and all the developer in the entire vessel is stirred and mixed effectively.

It will be apparent that various modifications may be made to the above specifically described arrangements without departing from the scope of the invention.

What is claimed is:

1. An electrostatic photographic copying machine comprising:

a rotatable master holding body adapted to have attached to the peripheral surface thereof an electrostatic photographic sensitive master paper;

a charging apparatus, a development apparatus and a transfer apparatus positioned along the passage of rotation of said surface of said master holding body;

an optical system to project an image of a copying original paper onto the surface of said master paper charged by said charging apparatus;

a transfer paper carrying passage to supply transfer paper to said transfer apparatus and to discharge transfer paper therefrom at a position whereat said image is transferred from said master paper to said transfer paper;

a fixing apparatus to fix the transferred image onto said transfer paper;

a master paper supply;

means for removing master paper from said surface of said master holding body;

means for feeding new master paper from said supply to said surface of said master holding body to replace the removed master paper; and means for rotating said master holding body in a first forward direction during normal operation of the machine and during feeding of said new master paper to said master holding body and in a second reverse direction during removal of said master paper from said master holding body.

2. An electrostatic photographic copying machine as claimed in claim 1, further comprising engaging means on said master holding body for engaging a forward end of master paper being supplied thereto by said master paper feeding means.

3. An electrostatic photographic copying machine as claimed in claim 2, wherein said master paper removing means comprises scraping means for scraping the rear end of master paper from said master holding body, and discharging means to discharge the thus scraped master paper from said master holding body.

4. An electrostatic photographic copying machine as claimed in claim 3, further comprising means for automatically controlling the operation of said feeding means to feed said master paper, said master holding body, said engaging means, said scraping means, and said discharging means so as to be synchronized to each other.

5. An electrostatic photographic copying machine as claimed in claim 3, wherein said master paper supply comprises a wound roll of master paper.

6. An electrostatic photographic copying machine as claimed in claim 5, further comprising cutting means for cutting master paper fed from said roll of master paper.

7. An electrostatic photographic copying machine as claimed in claim 6, further comprising means for automatically controlling the operation of said feeding means to feed said master paper, said cutting mechanism, said master holding body, said engaging means, said scraping means, and said discharging means so as to be synchronized to each other.

8. An electrostatic photographic copying machine as claimed in claim 3, wherein said master paper supply comprises means for supporting said master paper in stacked sheet form.

9. An electrostatic photographic copying machine as claimed in claim 2, wherein said engaging means comprises a restraining member having a stopper to restrain the front end of said master paper fed onto said master holding body by said feeding means, and a guide member means provided on said restraining member for guiding said front end of master paper to a prescribed position during attachment of said master paper and for promoting separation of said front end of master paper from said stopper during removal of said master paper.

10. An electrostatic photographic copying machine as claimed in claim 9, wherein said stopper comprises a plurality of needle-shaped projections extending from said restraining member.

11. An electrostatic photographic copying machine as claimed in claim 10, wherein said guide member means comprises a plurality of plate springs attached to said restraining member.

12. An electrostatic photographic copying machine as claimed in claim 9, wherein said guide member means comprises a plate spring attached to said restraining member and having a plurality of holes through which extend said needle-shaped projections.

13. An electrostatic photographic copying machine as claimed in claim 1, further comprising counting means for counting the number of copying operations of the master paper on said master holding body, and means operable by said counting means for indicating the need for exchanging master paper attached to said master holding body when a prescribed number of copying operations counted by said counting means have been counted.

14. An electrostatic photographic copying machine as claimed in claim 13, wherein said indicating means comprises a first gear, turning means operable by said counting means for turning said first gear by one pitch for each copying operation, a second gear operably meshing with said first gear to be turned by one pitch as said first gear is turned by a predetermined number of pitches, a third gear meshing with said second gear to be turned thereby, an indicator on said third gear movable to an exchange indicating position, and means for returning said third gear from said indicating position to original position upon operation of said feeding means to exchange master paper.

15. An electrostatic photographic copying machine as claimed in claim 1, further comprising means for cleaning a fixing roller of said fixing apparatus.

16. An electrostatic photographic copying machine as claimed in claim 15, further comprising counting mechanism means for counting the number of copying operations, and said cleaning apparatus comprising a cleaning cloth and means operable by said counting mechanism means for replacing said cloth when said counting mechanism means counts a prescribed number of copying operations.

17. An electrostatic photographic copying machine as claimed in claim 15, wherein said cleaning apparatus comprises a cleaning cloth wound in roll form and having a portion in contact with the other peripheral surface of said fixing roller, a winding cylindrical body to wind said cleaning cloth from the roll, and an electromagnetic solenoid to perform a winding operation of cleaning cloth by operating said winding cylindrical body.

18. An electrostatic photographic copying machine as claimed in claim 1, further comprising a suction-type separating drum to separate transfer paper from said master paper and arranged at a position spaced by a predetermined distance from said surface of said master holding body, and an elastic expanded portion projecting from said surface at a position adjacent the end of said transfer paper, said portion facilitating, separation of said transfer paper from said master holding body by cooperation with suction of said separating drum.

19. An electrostatic photographic copying machine as claimed in claim 18, wherein said elastic portion comprises a sponge body being arranged on said peripheral surface of said master holding body.

20. An electrostatic photographic copying machine as claimed in claim 18, wherein said elastic portion comprises a gap between said master paper and said surface of said master holding body.

21. An electrostatic photographic copying machine as claimed in claim 1, wherein said development apparatus includes toner supply means, and means for adjusting the amount of toner supplied thereby.

22. An electrostatic photographic copying machine as claimed in claim 21, wherein said adjusting means comprises a driving source, a ratchet mechanism positioned between said driving source and said toner supply means, and cam means for controlling a period of engagement of said ratchet mechanism, and means for adjusting the position of said cam means.

23. An electrostatic photographic copying machine as claimed in claim 21, wherein said toner supply means comprises a toner supplying hopper and a knurled roller mounted on a shaft at the bottom end of said hopper, and toner being supplied downwardly from said hopper in accordance with rotation of said knurled roller.

24. An electrostatic photographic copying machine as claimed in claim 22, wherein said ratchet mechanism comprises a cog and a cog-wheel, a disc pivotally mounting thereon said cog by means of a pin, said disc being connected by means of intermediate transmission means to said driving source to transmit power of said driving source as one body on a common axis, said disc being loosely and rotatively fitted onto a rotary shaft of said knurled roller together with said intermediate transmission means, said cog-wheel being fixed to an outer end of said rotary shaft of said knurled roller, a spring normally urging said cog into engagement with said cog-wheel, a pin on said cog and positioned to slidably contact a peripheral edge of said cam means, said cam means comprising an elliptic cam fixed to a shaft mounted eccentrically with respect to said rotary shaft of said knurled roller.

25. An electrostatic photographic copying machine as claimed in claim 1, wherein said transfer apparatus comprises a shield casing having a first opening facing said master holding body, at least one fine corona discharge wire positioned within said casing, said casing having a second opening therein at a side thereof opposite said first opening, and a toner receiver mounted at a position opposed to said second opening and spaced from said shield casing, said toner receiver being removably attached to the body of the machine.

26. A electrostatic photographic copying machine as claimed in claim 25, further comprising a cursor slidably fitted within said casing, and wherein said corona discharging wire is extended between bases attached to opposite ends of said cursor, said cursor having therein an opening positioned opposite said second opening of said shield casing.

27. An electrostatic photographic copying machine as claimed in claim 25, wherein said shield casing is positioned beneath said master holding body with said first opening facing upwardly.

28. An electrostatic photographic copying machine as claimed in claim 25, wherein said shield casing is positioned at a side of said master holding body with said first opening facing sideways, and said toner receiver is substantially L-shaped in section.

29. An electrostatic photographic copying machine as claimed in claim 1, further comprising a movable original paper mounting table, and means for detecting jamming of said transfer paper, said jamming detecting means comprises a first detector to detect the amount of movement of said original paper mounting table from a starting position, a second detector to detect the amount of rotary movement of said master holding body, a third detector positioned downstream of said fixing apparatus to detect existence of transfer paper, and electric circuit means for generating a paper jamming signal when said first detector and said second detector are operated normally and said third detector detects the absence of transfer paper.

30. An electrostatic photographic copying machine as claimed in claim 29, further comprising a projecting protruding from said original paper mounting table, and wherein said first detector comprises a first microswitch positioned to be contacted by said projection when said original paper mounting table is moved from said starting position to a prescribed position.

31. An electrostatic photographic copying machine as claimed in claim 30, further comprising a cam mounted to be rotated around the same axis as said master holding body, wherein said second detector comprises a second microswitch to be operated by said cam.

32. An electrostatic photographic copying machine as claimed in claim 31, wherein said third detector comprises a third microswitch.

33. An electrostatic photographic copying machine as claimed in claim 32, further comprising means for stopping rotation of said master holding body when a paper jamming signal is generated by said electric circuit means.

34. An electrostatic photographic copying machine as claimed in claim 1, wherein said development apparatus comprises a magnetic brush development apparatus provided with a magnetic brush roller, and further comprising a rotary agitator to agitate and mix development agent consisting of toner and carrier.

35. An electrostatic photographic copying machine as claimed in claim 34, wherein said agitator includes an intermediate part in the lengthwise direction thereof formed by an agitating vane, and opposite end parts formed by spiral members to carry development agent toward said intermediate part.

36. An electrostatic photographic copying machine as claimed in claim 35, wherein said agitating vane comprises four plates joined in a cross-shaped section.

37. An electrostatic photographic copying machine as claimed in claim 35, wherein said agitating vane has holes therein.

38. An electrostatic photographic copying machine comprising:

a rotatable master holding body adapted to have attached to the peripheral surface thereof an electrostatic photographic sensitive master paper;

a charging apparatus, a development apparatus and a transfer apparatus positioned along the passage of rotation of said surface of said master holding body;

an optical system to project an image of a copying original paper onto the surface of said master paper charged by said charging apparatus;

a transfer paper carrying passage to supply transfer paper to said transfer apparatus and to discharge transfer paper therefrom at a position whereat said image is transferred from said master paper to said transfer paper;

a fixing apparatus to fix the transferred image onto said transfer paper;

a master paper supply;

means for removing master paper from said surface of said master holding body;

means for feeding new master paper from said supply to said surface of said master holding body to replace the removed master paper; and counting means for counting the number of copying operations of the master paper on said master holding body, and means operable by said counting means for indicating the need for exchanging master paper attached to said master holding body when a prescribed number of copying operations counted by said counting means have been counted, said indicating means comprising a first gear, turning means operable by said counting means for turning said first gear by one pitch for each copying operation, a second gear operably meshing with said first gear to be turned by one pitch as said first gear is turned by a predetermined number of pitches, a third gear meshing with said second gear to be turned thereby, an indicator on said third gear movable to an exchange indicating position, and means for returning said third gear from said indicating position to an original position upon operation of said feeding means to exchange master paper.

39. An electrostatic photographic copying machine as claimed in claim 38, further comprising engaging means on said master holding body for engaging a forward end of master paper being supplied thereto by said master paper feeding means.

40. An electrostatic photographic copying machine as claimed in claim 39, wherein said master paper removing means comprises scraping means for scraping the rear end of master paper from said master holding body, and discharging means to discharge the thus scraped master paper from said master holding body.

41. An electrostatic photographic copying machine as claimed in claim 40, further comprising means for automatically controlling the operation of said feeding means to feed said master paper, said master holding body, said engaging means, said scraping means, and said discharging means so as to be synchronized to each other.

42. An electrostatic photographic copying machine as claimed in claim 40, wherein said master paper supply comprises a wound roll of master paper.

43. An electrostatic photographic copying machine as claimed in claim 42, further comprising cutting means for cutting master paper fed from said roll of master paper.

44. An electrostatic photographic copying machine as claimed in claim 43, further comprising means for automatically controlling the operation of said feeding means to feed said master paper, said cutting means, said master holding body, said engaging means, said scraping means, and said discharging means so as to be synchronized to each other.

45. An electrostatic photographic copying machine as claimed in claim 40, wherein said master paper supply comprises means for supporting said master paper in stacked sheet form.

46. An electrostatic photographic copying machine as claimed in claim 39, wherein said engaging means comprises a restraining member having a stopper to restrain the front end of said master paper fed onto said master holding body by said feeding means, and a guide member means provided on said restraining member for guiding said front end of master paper to a prescribed position during attachment of said master paper and for promoting separation of said front end of master paper from said stopper during removal of said master paper.

47. An electrostatic photographic copying machine as claimed in claim 46, wherein said stopper comprises a plurality of needle-shaped projections extending from said restraining member.

48. An electrostatic photographic copying machine as claimed in claim 47, wherein said guide member means comprises a plurality of plate springs attached to said restraining member.

49. An electrostatic photographic copying machine as claimed in claim 46, wherein said guide member means comprises a plate spring attached to said restraining member and having a plurality of holes through which extend said needle-shaped projections.

50. An electrostatic photographic copying machine as claimed in claim 38, further comprising means for cleaning a fixing roller of said fixing apparatus.

51. An electrostatic photographic copying machine as claimed in claim 50, further comprising counting mechanism means for counting the number of copying operations, and said cleaning means comprising a cleaning cloth and means operable by said counting mechanism means for replacing said cloth when said counting mechanism means counts a prescribed number of copying operations.

52. An electrostatic photographic copying machine as claimed in claim 50, wherein said cleaning means comprises a cleaning cloth wound in roll form and having a portion in contact with the outer peripheral surface of said fixing roller, a winding cylindrical body to wind said cleaning cloth from the roll, and an electromagnetic solenoid to perform a winding operation of cleaning cloth by operating said winding cylindrical body.

53. An electrostatic photographic copying machine as claimed in claim 38, further comprising a suction-type separating drum to separate transfer paper from said master paper and arranged at a position spaced by a predetermined distance from said surface of said master holding body, and an elastic expanded portion projecting from said surface at a position adjacent the end of said transfer paper, said portion facilitating separation of said transfer paper from said master holding body by cooperation with suction of said separating drum.

54. An electrostatic photographic copying machine as claimed in claim 53, wherein said elastic portion comprises a sponge body being arranged on said peripheral surface of said master holding body.

55. An electrostatic photographic copying machine as claimed in claim 53, wherein said elastic portion comprises a gap between said master paper and said surface of said master holding body.

56. An electrostatic photographic copying machine as claimed in claim 38, wherein said development apparatus includes toner supply means, and means for adjusting the amount of toner supplied thereby.

57. An electrostatic photographic copying machine as claimed in claim 56, wherein said adjusting means comprises a driving source, a ratchet mechanism positioned between said driving source and said toner supply means, and cam means for controlling a period of engagement of said ratchet mechanism, and means for adjusting the position of said cam means.

58. An electrostatic photographic copying machine as claimed in claim 57, wherein said toner supply means comprises a toner supplying hopper and a knurled roller mounted on a shaft at the bottom end of said hopper, and toner being supplied downwardly from said hopper in accordance with rotation of said knurled roller.

59. An electrostatic photographic copying machine as claimed in claim 57, wherein said ratchet mechanism comprises a cog and a cog-wheel, a disc pivotally mounting thereon said cog by means of a pin, said disc being connected by means of intermediate transmission means to said driving source to transmit power of said driving source as one body on a common axis, said disc being loosely and rotatively fitted onto a rotary shaft of said knurled roller together with said intermediate transmission means, said cog-wheel being fixed to an outer end of said rotary shaft of said knurled roller, a spring normally urging said cog into engagement with said cog-wheel, a pin on said cog and positioned to slidably contact a peripheral edge of said cam means, said cam means comprising an elliptic cam fixed to a shaft mounted eccentrically with respect to said rotary shaft of said knurled roller.

60. An electrostatic photographic copying machine as claimed in claim 38 wherein said transfer apparatus comprises a shield casing having a first opening facing said master holding body, at least one fine corona discharge wire positioned within said casing, said casing having a second opening therein at a side thereof opposite said first opening, and a toner receiver mounted at a position opposed to said second opening and spaced from said shield casing, said toner receiver being removably attached to the body of the machine.

61. A electrostatic photographic copying machine as claimed in claim 60, further comprising a cursor slidably fitted within said casing, and wherein said corona discharging wire is extended between bases attached to opposite ends of said cursor, said cursor having therein an opening positioned opposite said second opening of said shield casing.

62. An electrostatic photographic copying machine as claimed in claim 60, wherein said shield casing is positioned beneath said master holding body with said first opening facing upwardly.

63. An electrostatic photographic copying machine as claimed in claim 60, wherein said shield casing is positioned at a side of said master holding body with said first opening facing sideways, and said toner receiver is substantially L-shaped in section.

64. An electrostatic photographic copying machine as claimed in claim 38, further comprising a movable original paper mounting table, and means for detecting jamming of said transfer paper, said jamming detecting means comprises a first detector to detect the amount of movement of said original paper mounting table from a starting position, a second detector to detect the amount of rotary movement of said master holding body, a third detector positioned downstream of said fixing apparatus to detect existence of transfer paper, and electric circuit means for generating a paper jamming signal when said first detector and said second detector are operated normally and said third detector detects the absence of transfer paper.

65. An electrostatic photographic copying machine as claimed in claim 64, further comprising a projection protruding from said original paper mounting table, and wherein said first detector comprises a first microswitch positioned to be contacted by said projection when said original paper mounting table is moved from said starting position to a prescribed position.

66. An electrostatic photographic copying machine as claimed in claim 65, further comprising a cam mounted to be rotated around the same axis as said master holding body, wherein said second detector comprises a second microswitch to be operated by said cam.

67. An electrostatic photographic copying machine as claimed in claim 66, wherein said third detector comprises a third microswitch.

68. An electrostatic photographic copying machine as claimed in claim 67, further comprising means for stopping rotation of said master holding body when a paper jamming signal is generated by said electric circuit means.

69. An electrostatic photographic copying machine as claimed in claim 38 wherein said development apparatus comprises a magnetic brush development apparatus provided with a magnetic brush roller, and further comprising a rotary agitator to agitate and mix development agent consisting of toner and carrier.

70. An electrostatic photographic copying machine as claimed in claim 69, wherein said agitator includes an intermediate part in the lengthwise direction thereof formed by an agitating vane, and opposite end parts formed by spiral members to carry development agent toward said intermediate part.

71. An electrostatic photographic copying machine as claimed in claim 70, wherein said agitating vane comprises four plates joined in a cross-shaped section.

72. An electrostatic photographic copying machine as claimed in claim 70, wherein said agitating vane has holes therein.

73. An electrostatic photographic copying machine comprising:

a rotatable master holding body adapted to have attached to the peripheral surface thereof an electrostatic photographic sensitive master paper;

a charging apparatus, a development apparatus and a transfer apparatus positioned along the passage of rotation of said surface of said master holding body;

an optical system to project an image of a copying original paper onto the surface of said master paper charged by said charging apparatus;

a transfer paper carrying passage to supply transfer paper to said transfer apparatus and to discharge transfer paper therefrom at a position whereat said image is transferred from said master paper to said transfer paper;

a fixing apparatus to fix the transferred image onto said transfer paper;

a master paper supply;

means for removing master paper from said surface of said master holding body;

means for feeding new master paper from said supply to said surface of said master holding body to replace the removed master paper;

counting means for counting the number of copying operations of the master paper on said master holding body, and means operable by said counting means for indicating the need for exchanging master paper attached to said master holding body when a prescribed number of copying operations counted by said counting means have been counted;

engaging means on said master holding body for engaging a forward end of master paper being supplied thereto by said master paper feeding means; and said master paper removing means comprising scraping means for scraping the rear end of master paper from said master holding body, and discharging means to discharge the thus scraped master paper from said master holding body.

74. An electrostatic photographic copying machine as claimed in claim 73, further comprising means for automatically controlling the operation of said feeding means to feed said master paper, said master holding body, said engaging means, said scraping means, and said discharging means so as to be synchronized to each other.

75. An electrostatic photographic copying machine as claimed in claim 73, wherein said master paper supply comprises a wound roll of master paper.

76. An electrostatic photographic copying machine as claimed in claim 75, further comprising cutting means for cutting master paper fed from said roll of master paper.

77. An electrostatic photographic copying machine as claimed in claim 76, further comprising means for automatically controlling the operation of said feeding means to feed said master paper, said cutting means, said master holding body, said engaging means, said scraping means, and said discharging means so as to be synchronized to each other.

78. An electrostatic photographic copying machine as claimed in claim 73, wherein said master paper supply comprises means for supporting said master paper in stacked sheet form.

79. An electrostatic photographic copying machine comprising:

a rotatable master holding body adapted to have attached to the peripheral surface thereof an electrostatic photographic sensitive master paper;

a charging apparatus, a development apparatus and a transfer apparatus positioned along the passage of rotation of said surface of said master holding body;

an optical system to project an image of a copying original paper onto the surface of said master paper charged by said charging apparatus;

a transfer paper carrying passage to supply transfer paper to said transfer apparatus and to discharge transfer paper therefrom at a position whereat said image is transferred from said master paper to said transfer paper;

a fixing apparatus to fix the transferred image onto said transfer paper;

a master paper supply;

means for removing master paper from said surface of said master holding body;

means for feeding new master paper from said supply to said surface of said master holding body to replace the removed master paper;

counting means for counting the number of copying operations of the master paper on said master holding body, and means operable by said counting means for indicating the need for exchanging master paper attached to said master holding body when a prescribed number of copying operations counted by said counting means have been counted; and engaging means on said master holding body for engaging a forward end of master paper being supplied thereto by said master paper feeding means, said engaging means comprising a restraining member having a stopper to restrain the front end of said master paper fed onto said master holding body by said feeding means, and a guide member means provided on said restraining member for guiding said front end of master paper to a prescribed position during attachment of said master paper and for promoting separation of said front end of master paper from said stopper during removal of said master paper.

80. An electrostatic photographic copying machine as claimed in claim 79, wherein said stopper comprises a plurality of needle-shaped projections extending from said restraining member.

81. An electrostatic photographic copying machine as claimed in claim 80, wherein said guide member means comprises a plurality of plate springs attached to said restraining member.

82. An electrostatic photographic copying machine as claimed in claim 79, wherein said guide member means comprises a plate spring attached to said restraining member and having a plurality of holes through which extend said needle-shaped projections.

83. An electrostatic photographic copying machine comprising:

a rotatable master holding body adapted to have attached to the peripheral surface thereof an electrostatic photographic sensitive master paper;

a charging apparatus, a development apparatus and a transfer apparatus positioned along the passage of rotation of said surface of said master holding body;

an optical system to project an image of a copying original paper onto the surface of said master paper charged by said charging apparatus;

a transfer paper carrying passage to supply transfer paper to said transfer apparatus and to discharge transfer paper therefrom at a position whereat said image is transferred from said master paper to said transfer paper;

a fixing apparatus to fix the transferred image onto said transfer paper;

a master paper supply;

means for removing master paper from said surface of said master holding body;

means for feeding new master paper from said supply to said surface of said master holding body to replace the removed master paper;

counting means for counting the number of copying operations of the master paper on said master holding body, and means operable by said counting means for indicating the need for exchanging master paper attached to said master holding body when a prescribed number of copying operations counted by said counting means have been counted;

counting mechanism means for counting the number of copying operations; and means for cleaning a fixing roller of said fixing apparatus, said cleaning means comprising a cleaning cloth and means operable by said counting mechanism means for replacing said cloth when said counting mechanism means counts a prescribed number of copying operations.

84. An electrostatic photographic copying machine comprising:

a rotatable master holding body adapted to have attached to the peripheral surface thereof an electrostatic photographic sensitive master paper;

a charging apparatus, a development apparatus and a transfer apparatus positioned along the passage of rotation of said surface of said master holding body;

an optical system to project an image of a copying original paper onto the surface of said master paper charged by said charging apparatus;

a transfer paper carrying passage to supply transfer paper to said transfer apparatus and to discharge transfer paper therefrom at a position whereat said image is transferred from said master paper to said transfer paper;

a fixing apparatus to fix the transferred image onto said transfer paper;

a master paper supply;

means for removing master paper from said surface of said master holding body;

means for feeding new master paper from said supply to said surface of said master holding body to replace the removed master paper;

counting means for counting the number of copying operations of the master paper on said master holding body, and means operable by said counting means for indicating the need for exchanging master paper attached to said master holding body when a prescribed number of copying operations counted by said counting means have been counted; and a suction-type separating drum to separate transfer paper from said master paper and arranged at a position spaced by a predetermined distance from said surface of said master holding body, and an elastic expanded portion projecting from said surface at a position adjacent the end of said transfer paper, said portion facilitating separation of said transfer paper from said master holding body by cooperation with suction of said separating drum.

85. An electrostatic photographic copying machine as claimed in claim 84, wherein said elastic portion comprises a sponge body being arranged on said peripheral surface of said master holding body.

86. An electrostatic photographic copying machine as claimed in claim 84, wherein said elastic portion comprises a gap between said master paper and said surface of said master holding body.

87. An electrostatic photographic copying machine comprising:

a rotatable master holding body adapted to have attached to the peripheral surface thereof an electrostatic photographic sensitive master paper;

a charging apparatus, a development apparatus, including toner supply means and means for adjusting the amount of toner supplied thereto, and a transfer apparatus positioned along the passage of rotation of said surface of said master holding body;

an optical system to project an image of a copying original paper onto the surface of said master paper charged by said charging apparatus;

a transfer paper carrying passage to supply transfer paper to said transfer apparatus and to discharge transfer paper therefrom at a position whereat said image is transferred from said master paper to said transfer paper;

a fixing apparatus to fix the transferred image onto said transfer paper;

a master paper supply;

means for removing master paper from said surface of said master holding body;

means for feeding new master paper from said supply to said surface of said master holding body to replace the removed master paper; and counting means for counting the number of copying operations of the master paper on said master holding body, and means operable by said counting means for indicating the need for exchanging master paper attached to said master holding body when a prescribed number of copying operations counted by said counting means have been counted.

88. An electrostatic photographic copying machine as claimed in claim 87, wherein said adjusting means comprises a driving source, a ratchet mechanism positioned between said driving source and said toner supply means, and cam means for controlling a period of engagement of said ratchet mechanism, and means for adjusting the position of said cam means.

89. A electrostatic photographic copying machine as claimed in claim 88, wherein said toner supply means comprises a toner supplying hopper and a knurled roller mounted on a shaft at the bottom end of said hopper, and toner being supplied downwardly from said hopper in accordance with rotation of said knurled roller.

90. An electrostatic photographic copying machine as claimed in claim 88, wherein said ratchet mechanism comprises a cog and a cog-wheel, a disc pivotally mounting thereon said cog by means of a pin, said disc being connected by means of intermediate transmission means to said driving source to transmit power of said driving source as one body on a common axis, said disc being loosely and rotatively fitted onto a rotary shaft of said knurled roller together with said intermediate transmission means, said cog-wheel being fixed to an outer end of said rotary shaft of said knurled roller, a spring normally urging said cog into engagement with said cog-wheel, a pin on said cog and positioned to slidably contact a peripheral edge of said cam means, said cam means comprising an elliptic cam fixed to a shaft mounted eccentrically with respect to said rotary shaft of said knurled roller.

91. An electrostatic photographic copying machine comprising:

a rotatable master holding body adapted to have attached to the peripheral surface thereof an electrostatic photographic sensitive master paper;

a charging apparatus, a development apparatus and a transfer apparatus positioned along the passage of rotation of said surface of said master holding body;

an optical system to project an image of a copying original paper onto the surface of said master paper charged by said charging apparatus;

a transfer paper carrying passage to supply transfer paper to said transfer apparatus and to discharge transfer paper therefrom at a position whereat said image is transferred from said master paper to said transfer paper;

a fixing apparatus to fix the transferred image onto said transfer paper;

a master paper supply;

means for removing master paper from said surface of said master holding body;

means for feeding new master paper from said supply to said surface of said master holding body to replace the removed master paper;

counting means for counting the number of copying operations of the master paper on said master holding body, and means operable by said counting means for indicating the need for exchanging master paper attached to said master holding body when a prescribed number of copying operations counted by said counting means have been counted; and said transfer apparatus comprising a shield casing having a first opening facing said master holding body, at least one fine corona discharge wire positioned within said casing, said casing having a second opening therein at a side thereof opposite said first opening, and a toner receiver mounted at a positioned opposed to said second opening and spaced from said shield casing, said toner receiver being removably attached to the body of the machine.

92. An electrostatic photographic copying machine as claimed in claim 91, further comprising a cursor slidably fitted within said casing, and wherein said corona discharging wire is extended between bases attached to opposite ends of said cursor, said cursor having therein an opening positioned opposite said second opening of said shield casing.

93. An electrostatic photographic copying machine as claimed in claim 91, wherein said shield casing is positioned beneath said master holding body with said first opening facing upwardly.

94. An electrostatic photographic copying machine as claimed in claim 91, wherein said shield casing is positioned at a side of said master holding body with said first opening facing sideways, and said toner receiver is substantially L-shaped in section.

95. An electrostatic photographic copying machine comprising:

a rotatable master holding body adapted to have attached to the peripheral surface thereof an electrostatic photographic sensitive master paper;

a charging apparatus, a development apparatus and a transfer apparatus positioned along the passage of rotation of said surface of said master holding body;

an optical system to project an image of a copying original paper onto the surface of said master paper charged by said charging apparatus;

a transfer paper carrying passage to supply transfer paper to said transfer apparatus and to discharge transfer paper therefrom at a position whereat said image is transferred from said master paper to said transfer paper;

a fixing apparatus to fix the transferred image onto said transfer paper;

a master paper supply;

means for removing master paper from said surface of said master holding body;

means for feeding new master paper from said supply to said surface of said master holding body to replace the removed master paper;

counting means for counting the number of copying operations of the master paper on said master holding body, and means operable by said counting means for indicating the need for exchanging master paper attached to said master holding body when a prescribed number of copying operations counted by said counting means have been counted; and a movable original paper mounting table, and means for detecting jamming of said transfer paper, said jamming detecting means comprises a first detector to detect the amount of movement of said original paper mounting table from a starting position, a second detector to detect the amount of rotary movement of said master holding body, a third detector positioned downstream of said fixing apparatus to detect the existence of transfer paper, and electric circuit means for generating a paper jamming signal when said first detector and said second detector are operated normally and said third detector detects the absence of transfer paper.

96. An electrostatic photographic copying machine as claimed in claim 95, further comprising a projection protruding from said original paper mounting table, and wherein said first detector comprises a first microswitch positioned to be contacted by said projection when said original paper mounting table is moved from said starting position to a prescribed position.

97. An electrostatic photographic copying machine as claimed in claim 96, further comprising a cam mounted to be rotated around the same axis as said master holding body, wherein said second detector comprises a second microswitch to be operated by said cam.

98. An electrostatic photographic copying machine as claimed in claim 97, wherein said third detector comprises a third microswitch.

99. An electrostatic photographic copying machine as claimed in claim 98, further comprising means for stopping rotation of said master holding body when a paper jamming signal is generated by said electric circuit means.

100. An electrostatic photographic copying machine comprising:

a rotatable master holding body adapted to have attached to the peripheral surface thereof an electrostatic photographic sensitive master paper;

a charging apparatus, a magnetic brush development apparatus provided with a magnetic brush roller and a transfer apparatus positioned along the passage of rotation of said surface of said master holding body;

an optical system to project an image of a copying original paper onto the surface of said master paper charged by said charging apparatus;

a transfer paper carrying passage to supply transfer paper to said transfer apparatus and to discharge transfer paper therefrom at a position whereat said image is transferred from said master paper to said transfer paper;

a fixing apparatus to fix the transferred image onto said transfer paper;

a master paper supply;

means for removing master paper from said surface of said master holding body;

means for feeding new master paper from said supply to said surface of said master holding body to replace the removed master paper;

counting means for counting the number of copying operations of the master paper on said master holding body, and means operable by said counting means for indicating the need for exchanging master paper attached to said master holding body when a prescribed number of copying operations counted by said counting means have been counted; and a rotary agitator to agitate and mix development agent consisting of toner and carrier, said agitator including an intermediate part in the lengthwise direction thereof formed by an agitating vane, and opposite end parts formed by spiral members to carry development agent toward said intermediate part.

101. An electrostatic photographic copying machine as claimed in claim 100, wherein said agitating vane comprises four plates joined in a cross shaped section.

102. An electrostatic photographic copying machine as claimed in claim 100, wherein said agitating vane has holes therein.

* * * * *

UNITED STATES PATENT AND TRADEMARK OFFICE

CERTIFICATE OF CORRECTION

PATENT NO. : 4,179,211

DATED : December 18, 1979

INVENTOR(S) : Hiroshi Kimura et al.

It is certified that error appears in the above-identified patent and that said Letters Patent are hereby corrected as shown below:

Under Foreign Application Priority Data:

Line 4, change "Jun. 17, 1976" to --Jul. 17, 1976--;

Line 5, change "Jun. 17, 1976" to --Jul. 17, 1976--;

Line 6, change "Jun. 17, 1976" to --Jul. 17, 1976--.

Signed and Sealed this

*Third* Day of *November 1981*

[SEAL]

*Attest:*

GERALD J. MOSSINGHOFF

*Attesting Officer*

*Commissioner of Patents and Trademarks*